US005429901A

United States Patent [19]

Muto et al.

[11] Patent Number: 5,429,901

[45] Date of Patent: Jul. 4, 1995

[54] TONER FOR USE IN ELECTROSTATIC DEVELOPMENT

[75] Inventors: Kenkichi Muto, Numazu; Yohichiro Watanabe, Fuji; Akihiro Kotsugai, Shizuoka, all of Japan

[73] Assignee: Ricoh Company, Ltd., Tokyo, Japan

[21] Appl. No.: 138,354

[22] Filed: Oct. 18, 1993

[30] Foreign Application Priority Data

Oct. 19, 1992 [JP] Japan ..... 4-305987

[51] Int. Cl.[6] ..... G03G 9/097; G03G 9/093

[52] U.S. Cl. ..... 430/110; 430/111; 430/138

[58] Field of Search ..... 430/110, 111

[56] References Cited

U.S. PATENT DOCUMENTS 4,902,570 2/1990 Heinemann et al. ..... 430/110 X
4,902,598 2/1990 Winnik et al. ..... 430/110
4,965,158 10/1990 Gruber et al. ..... 430/110 X
5,021,317 6/1991 Matsubara et al. ..... 430/110
5,124,222 6/1992 Clark et al. ..... 430/110 X
5,320,926 6/1994 Ueda et al. ..... 430/110

FOREIGN PATENT DOCUMENTS 166151 7/1991 Japan .

*Primary Examiner*—Roland Martin
*Attorney, Agent, or Firm*—Cooper & Dunham

[57] ABSTRACT

A toner for use in electrostatic development is composed of toner particles, each toner particle being composed of a core particle containing a thermoplastic resin and a coloring agent; a releasing agent in the form of particles, which substantially cover the entire surface of the core particle; and a chargeable resin which covers at least part of the releasing agent.

5 Claims, No Drawings

TONER FOR USE IN ELECTROSTATIC DEVELOPMENT

BACKGROUND OF THE INVENTION

1. Field of the Invention

The present invention relates to a toner for use in electrostatic development, in particular, for use in electrophotography, electrostatic printing, electrostatic printing, and the like.

2. Discussion of Background

Generally in electrophotography and electrostatic printing, electrostatic images formed by various methods on an electrostatic image bearing member are developed by an appropriately charged toner to visible toner images. When necessary, such visible toner images are transferred to an image transfer medium and fixed thereto by the application of heat and/or pressure, whereby copies are obtained.

Currently a dry type development method is widely used for developing latent electrostatic images formed on an electrophotographic photoconductor or on an electrostatic recording medium.

In the dry type development method, there is employed toner which comprises a coloring agent such as a dye and/or a pigment, and when necessary, a releasing agent and a charge controlling agent, which are dispersed in the toner. More specifically, such toner is brought into contact with a charging member such as a blade or a roller, thereby charging the toner to a predetermined polarity, and then a thin layer of the toner is formed on a roller. The thus formed thin toner layer is brought to the vicinity of latent electrostatic images or into contact with latent electrostatic images, whereby the latent electrostatic images are developed to visible toner images. This development method is referred to as mono-component development method. In addition to this mono-component development method, a two-component development method is also employed, in which the above-mentioned toner is mixed with a carrier composed of finely-divided magnetic particles to charge the toner to a predetermined polarity and forms the charged toner into a magnetic brush, and latent electrostatic images are developed to visible toner images by the thus formed magnetic brush.

In the mono-component and two-component development methods, it is required that the toner be uniformly charged with an appropriate amount of electric charge.

Recently a toner capable of providing high quality images and hiving high durability is demanded. In order to meet this demand, it is required that the toner have a small particle size and a narrow particle size distribution, and that each toner particle of the toner have a smooth surface, and a charge controlling agent be uniformly dispersed in each toner particle.

More specifically, the particle size of the toner has a significant effect on the resolution, sharpness, and half-tone reproductivity of images. Furthermore, if the particle size distribution is broad, the durability of the toner is degraded because toner particles with particular particle sizes are selectively used in the development. In addition, when the surface of each toner particle is not smooth, toner particles are partially crushed by the stress applied thereto when the toner particles are stirred during the development, so that the toner particles are excessively finely divided. In the two-component development method, when the thus formed finely-divided toner particles adhere to carrier particles of a two-component developer, and the charging performance of the carrier particles is significantly degraded, while in the mono-component development method, when such finely-divided toner particles are fused to adhere to a member for forming a thin toner layer on a roller, non-printed lines are formed in the developed images.

Furthermore, when a charge controlling agent is not uniformly dispersed in each toner particle, the toner particles tend to be deposited on the background of images.

In the case of a conventional toner, which is produced by a conventional method, to be specific, by fusing and/or kneading a resin, a dye or pigment, a charge controlling agent and, if necessary, with the addition of other components, pulverizing the kneaded mixture by a mechanical or air-impaction pulverizer to produce toner particles, and classifying the toner particles, if toner particles with a small particle size and a narrow particle size distribution are to be produced, the production performance and yield thereof are significantly decreased and the production cost is high. Furthermore, the smaller the particle size, the poorer the charging performance of the toner because of the non-uniform dispersion of the charge controlling agent in each toner particle. In addition, in this case, many minute projections are formed on the surface of each toner particle during the pulverizing the toner so that such pulverized toner particles tend to adhere to the carrier particles or to a member for forming a thin toner layer on a roller.

In such a conventional toner, the charge controlling agent which is generally expensive and works only at the surface of each toner particle is also contained within each toner particle. Thus, the conventional toner is costly.

In order to eliminate the above-mentioned problems of the conventional toner, methods of fixing a charge controlling agent to the surface of a resin particle by striking a charge controlling agent into the resin particle by mechanical impact are disclosed, for instance, in Japanese Laid-Open Patent Applications 62-209541, 63-138358, 63-198070, and 63-311264. These methods would be useful to produce toner particles with a uniform chargeability if a finely-divided charge controlling agent with a uniform particle size distribution is employed. However, firstly, in practice, it is extremely difficult to obtain a finely-divided charge controlling agent with a uniform particle size distribution; and secondary, charge controlling agents generally have high melting points, and when toner particles with a charge controlling agent having such a high melting point at the surface of each toner particle are employed, an extremely large amount of thermal energy will be required for performing image fixing.

In order to transfer toner images formed on a latent image bearing material to an image transfer material and to fix the toner images thereto, a pressure-application heating method by use of a heating roller is in general use.

This method is advantageous over other methods in heat transfer efficiency and high speed image fixing performance. However, in this method, a so-called offset phenomenon tends to take place. This is such a phenomenon that a heated roller comes into direct contact with the surface of a fused toner image with the application of pressure thereto, so that part of a fused toner image is transferred to the surface of the heated roller and the partially transferred toner image is again transferred back to an image transfer material, smearing toner images with the re-transferred toner images.

In order to prevent the occurrence of the offset phenomenon, the surface of an image fixing roller is composed of a silicone rubber or a fluorocarbon resin with excellent releasability, and a releasing agent for preventing the offset phenomenon such as a silicone oil is supplied to an image fixing roller during image fixing. This method is very effective for preventing the offset phenomenon, but has the drawbacks that the releasing agent evaporates and gives an offensive odor when heated, and an apparatus for supplying the releasing agent is required. In order to solve these problems, a method of incorporating a resin with releasability into a toner has been proposed in Japanese Patent Publication 52-3304. This method, however, has the shortcoming that in order to obtain a sufficient releasability for use in practice, a large amount of the resin has to be incorporated into the toner, but it is difficult to uniformly disperse the resin in the toner because of the poor compatibility of a binder resin with the releasing agent used in the resin.

In order to solve these problems, methods of providing a releasing agent layer on an outer layer of a toner particle have been proposed, for instance, in Japanese Laid-Open Patent Applications 63-41861, 63-244053, and 63-300245. However, in these methods, since the surface of each toner particle is covered with a low-molecular-weight releasing agent, the toner particle does not retain an appropriate chargeability. The result is that stable development cannot be attained when used for an extended period of time or when there are changes in ambient conditions. Furthermore, the fluidity of the toner particles is significantly degraded so that it is difficult to smoothly supply the toner to a development section, and also it is difficult to conduct image transfer from a latent image bearing material to an image transfer material. In order to obtain sufficient fluidity and image transfer performance for use in practice, a large amount of a fluidity-imparting agent such as finely-divided inorganic particles is required. However, when such a fluidity-imparting agent is deposited on a photoconductor, the agent has adverse effects on developed images, for instance, with the formation of line-shaped non-developed portions in the developed images.

Japanese Laid-Open Patent Application 3-125156 discloses a method of providing a release-agent-containing resin layer on the surface of each toner particle by depositing on each toner particle finely-divided resin particles which contain a releasing agent.

Furthermore, Japanese Laid-Open Patent Applications 3-166551 and 3-180855 disclose methods of depositing finely-divided particles of a releasing agent and finely-divided particles of a resin on the surface of each toner particle, thereby providing a releasing-agent-containing resin layer on the surface of the toner particle.

In any of the above-mentioned methods, the releasing agent is unprotectedly present on the surface of each toner particle so that no solutions have been provided to the problems such as the degradation of the fluidity, transfer performance, and the degradation of the durability of toner, the filming of toner on the surface of a photoconductor, and the spent phenomenon of a carrier by the deposition of toner on the surface of the carrier.

SUMMARY OF THE INVENTION

It is therefore an object of the present invention to provide a toner for use in electrostatic development, which is capable of providing solutions to the above-mentioned problems of the conventional toners, which is capable of forming high quality images, with excellent resolution and image reproduction performance, and which is stable with respect to the charge quantity thereof for an extended period of time, even under some changes in the ambient conditions.

The object of the present invention can be achieved by a toner which comprises toner particles, each toner particle comprising a core particle which comprises a thermoplastic resin and a coloring agent; a releasing agent in the form of particles, which substantially cover the surface of the core particle; and a chargeable resin which covers at least part of the releasing agent.

In the present invention, it is preferable that chargeable resin further comprises a charge controlling agent, or that the chargeable resin have an anionic group, and a charge controlling function be imparted thereto by the reaction of the chargeable resin with a charge controlling compound selected from the group consisting of:

$$RfN^+(R_1)_3X^-, \quad \text{(Compound 1)}$$

(Compound 2)

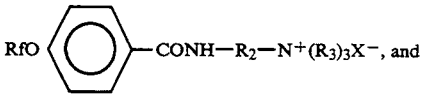

(Compound 3)

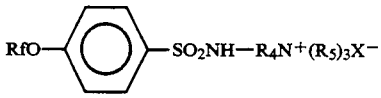

wherein Rf is a fluorine-containing group, preferably a straight or branched perfluoroalkyl group or perfluoroalkenyl group; $R_1$, $R_2$, $R_3$, $R_4$ and $R_5$ each represents a lower alkyl group, and $X^-$ is an organic or inorganic anion.

More specifically, according to the present invention, the surface of the core particle of each toner particle is substantially covered with the releasing agent, so that the so-called offset phenomenon, and the formation of marks which are otherwise made on the surface of an image transfer material by a pick-off pawl for separating the image transfer material from an image fixing roller can be prevented.

Further, according to the present invention, the releasing agent does not come into direct contact with members in a copying machine, so that the separation of the releasing agent form the toner particles and the making the members in the copying machine dirty with the separated releasing agent can be prevented.

Furthermore, the releasing agent does not have adverse effects on the chargeability of the toner, and does not degrade the fluidity of the toner, so that the toner with the above-mentioned advantageous features can be provided.

DETAILED DESCRIPTION OF THE PREFERRED EMBODIMENTS

The toner according to the present invention comprises toner particles, each toner particle comprising a core particle which comprises a coloring agent and a thermoplastic resin; a releasing agent in the form of particles, which substantially cover the surface of the core particle; and a chargeable resin which covers at least part of the releasing agent.

Because of the above-mentioned structure of the toner of the present invention, the releasing agent is prevented form being coming into contact with each other on the surface of the toner particle, with a photoconductor and also with carrier particles, so that the fluidity and image transfer performance of the toner are not decreased. Furthermore, the toner of the present invention is free from the problems of the filming on the carrier particles, and the spent phenomenon of the carrier particles, whereby the durability of the toner is significantly enhanced.

In the toner of the present invention, since the releasing agent is present near the surface of the toner particle, the releasing agent can be easily caused to come out to the surface of the toner particle by the application of heat thereto by an image fixing roller and the amount thereof can be appropriately adjusted so as to attain the offset prevention effect and pick-off pawl mark prevention effect by appropriately setting the thickness of the resin layer which covers at least part of the releasing agent.

More specifically, it is preferable that the thickness of the resin layer be not more than 0.5 μm. The thickness of the resin layer as being not more than 0.5 μm is a thickness determined by random measurement of the thickness of 20 spots in the resin layer by a transmission microscope and calculating an average thickness of the thickness of the resin layer.

The thus prepared toner of the present invention includes a uniform external layer with triboelectric properties and therefore has a uniform chargeability, so that the toner can provide high quality images, with excellent resolution and image reproduction performance.

The toner according to the present invention can be prepared by steps of (1) producing thermoplastic resin particles which include a pigment, which are referred to as core particles, (2) depositing a releasing agent in the form of particles on each of the above-mentioned core particles, and (3) providing a resin layer with triboelectric properties on the releasing agent particles.

[I] Formation of Core Particles (pigment-containing thermoplastic resin particles)

As the core particles for use in the toner of the present invention, particles prepared by kneading a conventional pigment and a conventional binder resin and crushing the kneaded mixture thereof, and particles prepared by suspension polymerization of a monomer which contains a pigment can be employed. For use in the present invention, however, particles prepared by dispersion polymerization are preferable because particles with a small particle size can be obtained with a narrow particle size distribution by dispersion polymerization.

The dispersion polymerization is performed by polymerizing a vinyl monomer in a solvent in which the vinyl monomer can be dissolved, but a polymer prepared from the vinyl monomer cannot be dissolved, in the presence of a dispersion stabilizer which is soluble in the solvent.

Examples of the vinyl monomer used in the above-mentioned dispersion polymerization are styrene, and styrene derivatives such as o-methylstyrene, m-methylstyrene, p-methylstyrene, α-methylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, p-phenylstyrene, p-chlorostyrene, and 3,4-dichlorostyrene; α-methyl aliphatic monocarboxylic acid esters such as methyl acrylate, ethyl acrylate, n-butyl acrylate, iso-butyl acrylate, propyl acrylate, n-octyl acrylate, dodecyl acrylate, lauryl acrylate, 2-ethylhexyl acrylate, stearyl acrylate, 2-chloroethyl acrylate, phenyl acrylate, methyl α-chloroacrylate, ethyl methacrylate, ethyl methacrylate, propyl methacrylate, n-butyl methacrylate, iso-butyl methacrylate, n-octyl methacrylate, dodecyl methacrylate, lauryl methacrylate, 2-ethylhexyl methacrylate, stearyl methacrylate, phenyl methacrylate, dimethylaminoethyl methacrylate, and diethylaminoethyl methacrylate; acrylic acid derivatives or methacrylic acid derivatives such as acrylonitrile, methacrylonitrile, and acrylamide; and halogenated vinyl compounds such as vinyl chloride, vinylidene chloride, vinyl bromide, and vinyl fluoride. These vinyl monomers can be used alone or in combination.

The resin for use in the present invention may be a polymer prepared by cross-linking polymerization by use of a cross-linking agent having two or more polymerizable double bonds, in order to enhance the anti-offset property of the toner.

Preferable examples of the cross-linking agent are aromatic divinyl compounds such as divinylbenzene, divinylnapthalene, and derivatives thereof; diethylene carboxylic acid esters such as ethylene glycol dimethacrylate, diethylene glycol methacrylate, triethylene glycol methacrylate, trimethylolpropane triacrylate, allyl methacrylate, tetraethylene glycol dimethacrylate, and 1,3-butadiol methacrylate; and divinyl compounds and compounds having three or more vinyl groups such as N,N-divinylaniline, divinyl ether, divinyl sulfide, and divinyl sulfone. These cross-linking agents can be used alone or in combination.

In order to adjust the average molecular weight of the polymer, the polymerization can be conducted in the presence of a compound having a large chain transfer constant such as a low-molecular-weight compound having a mercapto group, carbon tetrachloride, or carbon tetrabromide.

Examples of an initiator for the polymerization of the above-mentioned monomers are azo initiators such as 2,2'-azobisisobutylonitrile, and 2,2'-azobis(2,4-dimethylvaleronitrile); peroxide initiators such as lauryl peroxide, benzoyl peroxide, and tert-butyl-peroxoate; persulfide initiators such as potassium persulfate; and initiator systems of a persufide initiator in combination with sodium thiosulfate or amine.

It is preferable that the amount of such an initiator be in the range of 0.1 to 10 parts by weight to 100 parts by weight of the vinyl monomer.

It is preferable that the solvent employed in the dispersion polymerization to be hydrophilic organic solvent.

Examples of the hydrophilic organic solvent are alcohols such as methyl alcohol, ethyl alcohol, modified ethyl alcohol, iso-propyl alcohol, n-butyl alcohol, iso-butyl alcohol, tert-butyl alcohol, sec-butyl alcohol, tert-amyl alcohol, 3-pentanol, octyl alcohol, benzyl alcohol, cyclohexanol, furfuryl alcohol, tetra-hydro furfuryl alcohol, ethylene glycol, glycerin, and diethylene glycol; and ether alcohols such as methyl cellosolve, cellosolve, isopropyl cellosolve, butyl cellosolve, ethylene glycol monomethyl ether, ethylene glycol monoethyl ether, diethylene glycol monomethyl ether, and diethylene glycol monoethyl ether.

When necessary, these hydrophilic solvents can be used in combination with water or a lipophilic liquid in which the hydrophilic solvents are soluble.

It is preferable that the ratio of the amount of the vinyl monomer to that of the hydrophilic solvent be not more than about 1, more preferably, not more than ½.

As the dispersion stabilizer for use in the present invention, homopolymers of a monomer having a hydrophilic group, and hydrophilic-solvent-soluble copolymers of the aforementioned monomer and another monomer which is polymerizable with the monomer, are preferably employed.

Examples of the monomer having a hydrophilic group are acrylic acid, methacrylic acid, fumaric acid, maleic acid, maleic anhydride, 2-hydroxyethyl acrylate, 2-hydroxyethyl methacrylate, glycerin monoacrylic acid ester, glycerin monomethacrylic acid ester, vinyl alcohol, vinyl methyl ether, vinyl ethyl ether, vinyl acetate, vinyl propionate, acrylamide, methacrylamide, vinylpyridine, vinylpyrrolidone, vinylimidazole, and ethylene imine.

The amount of the dispersion stabilizer to be employed depends upon the kind of the polymerizable monomer for the formation of polymerized particles to be obtained, but it is preferable that the amount of the dispersion stabilizer be in the range of 0.1 to 10 parts by weight, more preferably in the range of 1 to 5 parts by weight, to 100 parts by weight of the hydrophilic organic solvent.

Particles for the core particles are prepared in accordance with the following procedure:

Any of the above-mentioned dispersion stabilizers is completely dissolved in the hydrophilic organic solvent placed in a polymerization reaction vessel. To this solution, one or more vinyl monomers are added, and the air in the polymerization reaction vessel is replaced with an inert gas such as nitrogen or argon. Any of the above-mentioned initiators is added to the reaction mixture. The polymerization is conducted in such a manner that the reaction mixture is uniformly stirred so as to cause the reaction mixture to flow at a uniform speed within the polymerization reaction vessel, at a temperature corresponding to the decomposition rate of the initiator employed.

5 to 40 hours of the polymerization time is required to obtain a polymer with high polymerization degree. The polymerization can be terminated as desired in accordance with the particle size and particle size distribution of the polymer particles to be obtained, and the polymerization rats can be increased by the successive addition of the initiator or by conducting the polymerization under high pressure.

Thus, the polymer particles for use in the present invention can be prepared. The thus prepared polymer particles can be dyed as they are. Alternatively, the polymer particles may be subjected to sedimentation separation, centrifugation, or decantation to remove therefrom unnecessary particles, the remaining monomer, and the dispersion stabilizer, thereby recovering the polymer particles in the form of a polymer slurry, and the thus recovered polymer slurry may be dyed. However, it is preferable that the dispersion stabilizer not be removed in view of the stabilization of the polymer particle system during the dyeing process. When the dispersion stabilizer is not removed, unnecessary aggregation of the polymer particle system can be hindered.

In the present invention, the polymer particles (hereinafter referred to as the resin particles) are dyed as follows:

The resin particles are dispersed in an organic solvent in which the resin particles are not soluble. Before or after dispersing the resin particles in the organic solvent, a dye is dissolved in the organic solvent, so that the resin particles are dyed. The organic solvent is then removed from the mixture of the organic solvent, the dye and the resin particles, whereby dyed resin particles are obtained.

As the above-mentioned dye, it is preferable to use a dye which satisfies the relationship of $[D_1]/[D_2] \leqq 0.5$, wherein $[D_1]$ is the solubility of the dye in the organic solvent, and $[D_2]$ is the solubility of the dye in the resin for the resin particles. By using such a dye, a toner containing the resin particles which are dyed into the deep portion thereof can be efficiently produced.

Furthermore, it is preferable that the above-mentioned mixture be stirred during the dyeing process, with the liquid temperature thereof maintained below the glass transition temperature of the resin particles, whereby the diffusion rate of the dye into the resin particles can be increased. Sufficiently dyed resin particles can be obtained by the stirring for about 30 minutes to 6 hours.

Alternatively, the dyeing can be conducted by adding the dye directly to the above-mentioned polymer slurry, with stirring, with the application of heat, which polymer slurry is obtained at the completion of the polymerization and is in such a state that the polymer particles are dispersed in the organic solvent.

In the present invention, vat dye, disperse dye, and oil-soluble dye are preferably employed as the above-mentioned dye. In particular, oil-soluble dye is most suitable for use in the present invention.

Depending upon the desired color tone, several kinds of dyes can also be used in combination. The ratio of the amount of the dye to that of the resin particles can be determined as desired in accordance with the degree of pigmentation to be obtained, but generally it is preferable that the amount of the dye be in the range of 1 to 50 parts by weight to 100 parts by weight of the resin particles.

For instance, when an alcohol such as methanol or ethanol, having a high SP value, is employed as the solvent for the dyeing, and a styrene-acryl resin having an SP value of about 9 is employed as the resin for the resin particles, for example, the following dyes can be employed:

C.I. Solvent Yellow (6 9, 17, 31, 35, 100, 102, 103, 105),
C.I. Solvent Orange (2, 7, 13, 14, 66),
C.I. Solvent Red (5, 16, 17, 18, 19, 22, 23, 143, 145, 146, 149, 150, 151, 157, 158),
C.I. Solvent Violet (31, 32, 33, 37),
C.I. Solvent Blue (22, 63, 78, 83–86, 91, 94, 95, 104),
C.I. Solvent Green (24, 25), and
C.I. Solvent Brown (3, 9).

Commercially available dyes are, for example, Aizen SOT Dye Yellow-1, 3, 4, Orange-1, 2, 3, Scarlet-1, Red-1, 2, 3, Brown-2, Blue-1, 2, Violet-1, Green-1, 2, 3, Black-1, 4, 6, 8 (made by Hodogaya Chemical Co., Ltd.); Sudan Dye, Yellow-140, 150, Orange-220, Red-290, 380, 460, Blue-670 (commercially available from BASF Japan Ltd.); Diaresin, Yellow-3G, F, H, 2G, HG, HC, HI, Orange-HS, G, Red-GG, S, HS, A, K, H58, Violet-D, Blue-J, G, N, K, P, H3G, 4G, Green-C, Brown-A (made by Mitsubishi Chemical Industries, Ltd.); Oil Color, Yellow-3G, GG-S, #105, Orange-SP, PR, #201, Scarlet-#308, Red-5B, Brown-GR, #416, Green-BG, #502, Blue-BOS, and HN, Black-HBB, #803, EE, EX (made by Orient Chemical Industries, Ltd.); Sumiplast, Blue GP, OR red FB, 3B, Yellow FL7G, GC (made by Sumitomo Chemical Co., Ltd.); Kayalon, Polyester Black EX-SH300, Kayaset Red-B, Blue-A-2R (made by Nippon Kayak Co., Ltd.).

The commercially available dyes are not limited to the above because the dyes for use in the present invention can be appropriately selected in accordance with the combination of the resin particles and solvent employed in the dyeing process.

[II] Formation of Releasing Agent Layer

It is preferable that the releasing agent be in the form of finely-divided particles with a particle size which is not more than 1/10 the particle size of the dyed resin particles in order to cause the releasing agent to be uniformly deposited on the surface of each of the dyed resin particles.

Furthermore, it is preferable that the amount of the releasing agent to be deposited on the dyed resin particles be in the range of 0.5 to 5 parts by weight to 100 parts by weight of the dyed resin particles in order to prevent the offset phenomenon and to obtain sufficient image transfer performance.

It is preferable that releasing agent particles be produced in a state of a dispersion so as to make it possible to uniformly mix the releasing agent particles with the dyed resin particles.

Such releasing agent dispersions are commercially available and also can be prepared, for example, by the following conventional methods:

(1) A releasing agent is dissolved in a solvent A in which the releasing agent is soluble to prepare a solution. This solution with stirring at high speed to a solvent B, which is compatible with solvent A, but in which the releasing agent is not soluble, to precipitate the releasing agent in the form of finely-divided particles.

(2) Hot water is added to a liquid in which a releasing agent is fused, with stirring at high speed to prepare a dispersion of the releasing agent. The dispersion is then cooled to obtain an emulsion of the releasing agent.

(3) A releasing agent is mixed with a liquid C in which the releasing agent is not soluble in a dispersing apparatus such as a ball mill to disperse the releasing agent in the liquid.

To the above prepared dispersions, conventional surface active agents, polymer dispersing agents, and inorganic ions, which serve as dispersion stabilizers, can be added alone or in combination.

As the releasing agent mentioned here, any material can be employed so long as it is melted when image fixing is performed by use of a heat roller, and prevents toner from adhering to the heat roller and to an image transfer material. In other words, all the materials that can prevent the previously mentioned offset phenomenon can be used as the releasing agent.

Examples of such materials are low-molecular-weight polyolefins with a number average molecular weight of 1,000 to 20,000, such as polypropylene, polyethylene, polypropylene oxide, and polyethylene oxide; vegetable natural waxes such as candelilla wax, carnauba wax, and Japan wax; mineral natural waxes such as montan wax, ceresine, and ozocerite; petroleum waxes such as paraffin wax, microcrystalline wax, petrolatum and modified waxes thereof; solid higher fatty acids such as palmitic acid, stearic acid, and behenic acid; alkali metal salts, zinc salt, and aluminum salt of higher fatty acids such as potassium stearate, aluminum stearate, calcium palmitate, and zinc palmitate; higher fatty acid esters such as octadecyl stearate, and glycerin monstearate; amides such as lauramide, stearamide, N,N'-ethylenebisoleic acid amide, and N,N'-ethylenebisstearic acid amid; and ketones such as diheptadecyl ketone, and undecyl ketone.

The releasing agent particles can be deposited on the dyed resin particles by mixing the dyed resin particles with the releasing agent in the form of finely-divided particles in a dry state. However, since the finely-divided releasing agent tends to aggregate, it is difficult to uniformly mix the two components. Therefore, it is preferable to mix a dispersion liquid of the releasing agent with a dispersion liquid of the dyed resin particles in order to uniformly deposit the releasing agent particles on the surface of each of the dyed resin particles.

The releasing agent particles may be deposited on the dyed resin particles by merely mixing the releasing agent particles and the dyed resin particles, but the releasing agent particles can be firmly deposited on the dyed resin particles by any of the following methods:

(1) The pH of the dispersion liquid of the releasing agent and that of the dispersion liquid of the dyed resin particles are appropriately adjusted by the addition of an acid or alkali thereto;

(2) an anionic surface active agent or a cationic surface active agent is added to the dispersions; and (3) an electrolytic material is added to the dispersions.

By any of these methods, the potential of the dyed resin particles in the dispersion is reversed with respect to the potential of the releasing agent particles, or the difference between the potential of the dyed resin particles and that of the releasing agent particles is increased even if the polarities of the dyed resin particles and the releasing agent particles are maintained the same, so that the releasing agent particles can be uniformly and firmly deposited on the dyed resin particles. The potentials of the two dispersions can be adjusted either before or after the two dispersions are mixed.

It is preferable that the dyed resin particles ion which the releasing agent particles are deposited be subjected to a heat treatment in order to prevent the releasing agent particles from being detached from the dyed resin particles. More specifically, it is preferable that the heat treatment be conducted at a temperature in the range of 40° C. to 60° C. to form a releasing agent layer which is firmly deposited on the dyed resin particles. The releasing agent layer formed in this case may be either a uniform layer formed on the surface of each of the dyed resin particles or in the form of finely-divided particles deposited on the surface of each of the dyed resin particles.

After the formation of such a releasing agent layer on each of the dyed resin particles, the particles are washed to remove unnecessary additives therefrom, and a chargeable resin layer, which is an external layer of each toner particle, is then formed. For the formation of the chargeable resin layer, the dyed resin particles on which the releasing agent layer is deposited are moved in the state of a dried powder or in the state of a liquid dispersion. The releasing-agent-layer-deposited dyed resin particles can be dried after the filtration of the dyed resin particles or by subjecting the dyed resin particles to spray drying. When necessary, the releasing agent can be fixed to the dyed resin particles by applying mechanical impact to the dyed resin particles coated with the releasing agent layer.

[III] Formation of Chargeable Resin Layer

The following methods can be employed for the formation of a chargeable resin layer on the dyed resin particles coated with the releasing agent layer, which dyed resin particles are hereinafter referred to as the releasing agent coated particles:

(1) A method of coating the releasing-agent-coated particles with chargeable finely-divided resin particles.

(2) A method of coating the releasing-agent-coated particles with finely-divided charge controlling agent particles and chargeable finely-divided resin particles.

(3) A method of depositing a chargeable resin on the releasing-agent-coated particles.

(4) A method of coating the releasing-agent-coated particles with a solution of a chargeable resin and drying the coated resin particles.

(5) A method of coating the releasing-agent-coated particles with a solution of an alkoxysilane compound, which contains a charge controlling agent, and subjecting the thus coated particles to condensation polymerization.

(6) A method of coating the releasing-agent-coated particles with a solution of an alkoxysilane compound, which contains a chargeable resin, and subjecting the thus coated particles to condensation polymerization.

(7) A method of coating the releasing-agent-coated particles with an alkoxysilane compound having a chargeable group.

The above-mentioned methods will now be explained in more detail.

(1) The Method of Coating the Releasing-Agent-Coated Particles with Chargeable Finely-Divided Resin Particles It is preferable that the average particle size of the chargeable finely-divided resin particles be not more than 1/10 the average particle size of the releasing agent coated particles for each uniform coating of the releasing agent coated particles with the chargeable finely-divided resin particles.

The chargeable finely-divided resin particles can be prepared by crushing a resin having charge controlling performance in a dry state or in a wet state, by subjecting a monomer having charge controlling performance to emulsion polymerization or suspension polymerization, or by adding a solution of a resin having charge controlling performance dropwise to a bad solvent, thereby reprecipitating the resin in the form of finely-divided particles. Soap-free emulsion polymerization is a preferable method for the preparation of the chargeable finely-divided resin particles since the particle size and composition of the resin particles obtained are uniform and the surface of each resin particle is not contaminated with an emulsifier.

The soap-free emulsion polymerization is conducted by adding a polymerizable vinyl monomer to a hydrophilic solvent in the absence of an emulsifier or in the presence of a slight amount of an emulsifier, with the replacement of the air with an inert gas such as nitrogen, adding a water-soluble initiator thereto, and heating the reaction mixture with stirring in the atmosphere of the inert gas.

As the monomer employed in the above soap-free emulsion polymerization, the monomers employed for the preparation of the dyed resin particles can be employed, but it is necessary to copolymerize the monomers with a monomer having a chargeable group. Examples of a positively chargeable group are primary, secondary and tertiary amine groups, and quaternary ammonium group.

A negative chargeability can be imparted to the chargeable finely-divided resin particles by introducing thereto an anionic group. For this purpose, sulfonic acid group is preferable because of its strong, negative chargeability. The sulfonic acid group may be present in the form of a salt, such as alkali metal salt, ammonium salt, and amine salt.

It is also effective to copolymerize monomers having a fluoroalkyl group. An anionic group can be introduced by a secondary method using a moiety of an initiator having an anionic group such as persulfate, or a dispersion stabilizer or emulsifier having an anionic group. However, a method of copolymerizing a monomer having an anionic group is preferable. Examples of the monomer having an anionic group are (meth)acrylic acid, (meth)acrylic acid oxyethyl acid phosphate, styrene sulfonic acid, (meth)acrylic acid 2-sulfoethyl, (meth)acrylamide-2-methylpropane sulfonic acid, and alkali metal salts and ammonium salts of these monomers.

Chargeable finely-divided resin particles having dissociative functional groups at the surface thereof are generally highly hydrophilic, so that the charge quantity thereof decreases at high temperatures and high humidities. However, by allowing a fluorine-containing quaternary ammonium salt to react with the anionic group, stable, high negative chargeability can be obtained, without the charge quantity being decreased, even at high temperatures and high humidities.

Examples of the fluorine-containing quaternary ammonium slat are all quaternary ammonium salts having a straight or branched fluoroalkyl group or fluoroalkenyl group. The following fluorine-containing quaternary ammonium salts are particularly useful in the present invention:

$$RfN^+(R_1)_3X^-, \quad \text{(Compound 1)}$$

(Compound 2)

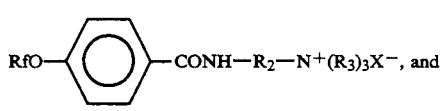

(Compound 3)

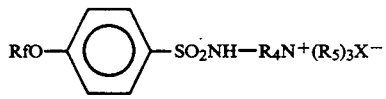

where Rf is a fluorine-containing group, preferably a straight or branched perfluoroalkyl group or perfluoroalkenyl group; $R_1$, $R_2$, $R_3$, $R_4$ and $R_5$ each represents a lower alkyl group, and $X^-$ is an organic or inorganic anion.

The fluorine-containing ammonium salt can be easily allowed to react with the chargeable finely-divided particles by adding the fluorine-containing ammonium salt to a dispersion of the chargeable finely-divided particles, and when necessary, by heating the mixture.

Alternatively, the chargeable finely-divided resin particles are deposited on the releasing-agent-coated particles, and a fluorine-containing quaternary ammonium salt solution is sprayed on the above particles. ammonium salt solution may be added to a dispersion liquid of the releasing-agent-coated particles on which the chargeable finely-divided particles are deposited.

Furthermore, a mixture of the chargeable finely-divided resin particles and the fluorine-containing quaternary ammonium salt may be deposited on the releasing-agent-coated particles, followed by allowing the fluorine-containing quaternary ammonium salt to react with the chargeable finely-divided resin particles by the application of mechanical impact or heat.

The releasing-agent-coated particles can be coated with chargeable finely-divided resin particles by subjecting a dispersion liquid of chargeable finely-divided resin particles to spraying drying or refrigeration drying to obtain finely-divided resin particles, mixing the thus obtained finely-divided resin particles and the releasing-agent-coated particles in a dry state, followed by the application of mechanical impact to the mixture, with the application of heat if necessary, or by the spraying of a solvent in which the finely-divided resin particles are soluble, with the application of heat if necessary.

Furthermore, a dispersion liquid of the finely-divided resin particles and a dispersion liquid of the releasing-agent-coated particles are mixed, if necessary, with the adjustment of the pH of the mixture, or with the addition of an ionic emulsifier, an ionic polymer or an electrolyte, whereby the chargeable finely-divided resin particles can be uniformly deposited on the surface of each of the releasing-agent-coated particles.

The adjustment of the pH, and the addition of the additives such as ionic emulsifier, ionic polymer and electrolyte, may be performed to at least one of the two dispersion liquids before the two dispersion liquids are mixed. After the chargeable finely-divided resin particles are uniformly deposited on the releasing-agent-coated particles, a chargeable resin layer, which is the external layer of each toner particle, may be formed by drying the releasing-agent-coated particles on which the chargeable finely-divided resin particles are deposited and applying mechanical impact thereto, with the application of heat thereto if necessary, or by spray drying the particles, with the application of heat thereto if necessary.

It is preferable that the parts-by-weight ratio of the amount of the releasing-agent-coated particles to that of the chargeable finely-divided resin particles be in the range of (100:1) to (100:20), more preferably in the range of (100:3) to (100:15).

(2) The Method of Coating the Releasing-Agent-Coated Particles with Finely-Divided Charge Controlling Agent Particles and with Chargeable Finely-Divided Resin Particles As the charge controlling agent for use in this method, conventionally known charge controlling agents for use in the conventional toners which are prepared by kneading and crushing can be employed.

It is preferable that the particle size of the charge controlling agent be not more than 1/10 the particle size of the releasing-agent-coated particles in order to uniformly deposit the charge controlling agent on the surface of the releasing-agent-coated particles by mixing the charge controlling agent and the releasing-agent-coated particles. For this purpose, when the charge controlling agent has a larger particle size than that mentioned above, it is necessary to crush or recrystallize the charge controlling agent to prepare finely-divided charge controlling agent particles with an appropriate particle size.

Specific examples of the charge controlling agent are as follows:

Nigrosine, azine dyes with a $C_{2-16}$ alkyl group (Japanese Patent Publication 42-1627), basic dyes such as C.I. Basic Yellow 2 (C.I. 41000), Basic Red 1 (C.I. 45160), C.I. Basic Red 9 (C.I. 42500), C.I. Basic Violet 1 (C.I. 42535), C.I. Basic Violet 3 (C.I. 42555), C.I. Basic Violet 10 (C.I. 45170), C.I. Basic Violet 14 (C.I. 42510), C.I. Basic Blue 1 (C.I. 42025), C.I. Basic Blue 3 (C.I. 51005), C.I. Basic Blue 5 (C.I. 42140), C.I. Basic Blue 7 (C.I. 42595), C.I. Basic Blue 9 (C.I. 52015), C.I. Basic Blue 24 (C.I. 52030), C.I. Basic Blue 25 C.I. 52025), C.I. Basic Blue 26 (C.I. 44045), C.I. Basic Green 1 (C.I. 42040), and C.I. Basic Green 4 (C.I. 42000); lake pigments of these basic dyes (laking agents are phosphorus wolframic acid, phosphorous molybdic acid, phosphorous tungstic molybdic acid, tunnic acid, lauric acid, gallic acid, ferricyande, and ferrocyanide); C.I. Solvent Black 3 (C.I. 26150), Hansa Yellow G (C.I. 11680), C.I. Mordlant Black 11, C.I. Pigment Black 1; benzomethyl hexadecyl ammonium chloride, decyl-trimethyl ammonium chloride, dialkyltin compounds such as dibutyltin and dioctyltin, dialkyltin borate compounds such as dibutyltin borate and dioctyltin borate, guanidine derivatives, polyamine resins such as vinyl polymers having amino group, and condensed polymers having amino group, and metal complex salts of monoazo dyes described in Japanese Patent Publications 41-20153, 43-27596, 44-6397, and 45-26478, metal complexes such as Zn, Al, Co, Cr and Fe complexes of salicylic acid, dialkyl salicylic acid, naphthoic acid and dicarboxylic acid, and sulfonated copper phthalocyanine pigments described in Japanese Patent Publications 55-42752, 58-41508, 58-7384, and 59-7385.

These charge controlling agents generally have high melting points. Therefore, when the outer layer of each toner particle is composed of such a charge controlling agent only, the image fixing performance of the toner is considerably degraded. In order to avoid this problem, chargeable finely-divided resin particles are used in combination with any of the above charge controlling agents, whereby a toner with satisfactory charging and image fixing characteristics can be obtained.

In the case of negative charging, chargeable finely-divided resin particles with anionic groups, which are mentioned in the above item (1) may be employed. However, those resin particles have the shortcoming that the chargeability is degraded at high temperatures and high humidities, so that it is preferable to use resin particles prepared by the copolymerization of a monomer having a fluoroalkyl group.

Examples of such a monomer having a fluoroalkyl group are trifluoroethyl acrylate, trifluoroethyl methacrylate, tetrafluoropropyl acrylate, tetrafluoropropyl methacrylate, octafluoropentyl acrylate, and octafluoropentyl methacrylate.

Counterpart monomers that can be used for the above copolymerization are those given in the preparation of the dyed finely-divided resin particles. It is preferable that the Tg of the thus copolymerized resin particles to be in the range of 50° C. to 80° C. to obtain satisfactory heat resistant properties and image fixing properties.

As mentioned previously, the soap-free emulsion polymerization method is suitable for the method of producing chargeable finely-divided resin particles because the soap-free emulsion polymerization method is capable of providing finely-divided resin particles with a uniform particle size free from contaminations.

Charge controlling agent particles and chargeable finely-divided resin particles can be deposited on the releasing-agent-coated resin particles in a dispersion liquid. However it is difficult to uniformly deposit both particles on the releasing-agent-coated resin particles in a dispersion liquid. Therefore it is preferable that such deposition be carried out in a dry state.

It is preferable that the parts-by-weight ratio of the amount of the releasing-agent-coated particles to that of the charge controlling agent be in the range of (100:0.1) to (100:1) for obtaining satisfactory charging characteristics and image fixing performance.

Furthermore, it is preferable that the parts-by-weight ratio of the amount of the releasing-agent-coated particles to that of the chargeable finely-divided resin particles be in the range of (100:1) to (100:10) for obtaining satisfactory image fixing performance and releasability.

The coating layer of the charge controlling agent and the chargeable finely-divided resin particles can be formed on the releasing-agent-coated particles by depositing the charge controlling agent and the chargeable finely-divided resin particles on the releasing-agent-coated particles, followed by heating the particles, or by adding to the particles a good solvent for the chargeable finely-divided resin particles. However, it is preferable that the coating layer of the charge controlling agent and the chargeable finely-divided resin particles be formed on the releasing-agent-coated particles by applying mechanical impact to those particles.

The above-mentioned mechanical impact can be applied by stirring a mixture of the charge controlling agent, the chargeable finely-divided resin particles and the releasing-agent-coated particles by use of rotary blades which rotate at high speed, or by causing the mixture to flow in a high-speed air stream to have the particles collided with each other or with an appropriate collision board.

Specific examples of a commercially available apparatus for applying the mechanical impact to the mixture of the charge controlling agent, the chargeable finely-divided resin particles and the releasing-agent-coated particles are an apparatus (Trademark "Mechanofusion" made by Hosokawa Micron Co., Ltd.), a jet mill (Trademark "I-Type Jett Mill" made by Nippon Pneumatic MFG. Co., Ltd.), and a hybridizer (Trademark "Hybridization System" made by Nara Machinery Co., Ltd.).

(3) The Method of Depositing a Chargeable Resin on the Releasing-Agent-Coated Particles The chargeable resin employed in this method is required to be soluble in a dispersion medium or dispersant of a dispersion liquid of the releasing-agent-coated particles and to have chargeable functional groups. Resins prepared by conventional copolymerization methods can be used as such chargeable resins. Resins prepared in a hydrophilic solvent by solution polymerization are preferable for use. The "hydrophilic solvent" used here is required to be a solvent in which the releasing-agent-coated particles are not soluble, but which is miscible with water and with the dispersant for the releasing-agent-coated particles. Specific examples of such a hydrophilic solvent are lower alkyl groups such as methanol and ethanol.

A resin with an improved negative chargeability can be prepared by copolymerization of vinyl monomers having an anionic group.

The term "anionic group" means the same group as mentioned previously for the finely-divided resin in the method (1) for the coating the releasing-agent-coated particles with chargeable finely-divided resin particles and the same vinyl monomers having the anionic group as in the method (1) can be employed. As the counterpart monomers for this copolymerization, the same monomers as employed in the preparation of the dyed resin particles can be employed. It is preferable that the thus prepared copolymers have a glass transition temperature (Tg) in the range of 50° C. to 80° C.

When an outer layer for each toner particle is prepared from a resin having such an anionic group, the chargeability of the toner is degraded at high temperatures and high humidities. In order to maintain high chargeability, it is preferable that any of the fluorine-containing quaternary ammonium slats previously mentioned in the method (1) be allowed to react with the resin having an anionic group.

This reaction can be easily carried out by adding any of the fluorine-containing quaternary ammonium salts or a solution thereof to a solution of the resin having an anionic group, and mixing the mixture, when necessary with the application of heat thereto.

A chargeable resin can be deposited on the surface of the releasing-agent-coated particles by dissolving the chargeable resin in a dispersion of the releasing-agent-coated particles, or by mixing the dispersion of the releasing-agent-coated particles with a solution of the chargeable resin, and adding dropwise to the mixture a solvent in which neither the releasing-agent-coated particles nor the chargeable resin is soluble, but which is miscible with the dispersant of the dispersion of the releasing-agent-coated particles, whereby the chargeable resin is caused to precipitate and is deposited on the surface of each of the releasing-agent-coated particles.

The precipitation of the chargeable resin particles can be promoted by changing the temperature of the above-mentioned mixture by cooling or heating the mixture, or by adding a monovalent inorganic ion, preferably a di- or more valent inorganic ion, to the above-mentioned solvent to be added, to the dispersion, or to the solution of the chargeable resin. As such ions, conventional ions can be employed. Examples of such ions are as follows:

$SO_4^{2-}$, $NO_2^-$, $PO_4^{3-}$, $Cl^-$, $Na^+$, $Mg^{2+}$, and $Ca^{2+}$.

In order to deposit the chargeable resin on the surface of each of the releasing-agent-coated particles speedily, the deposition can be carried out in the presence of an electrolyte with high absorbability such as a surfactant. As such a surfactant for use in this method, conventionally employed surfactants can be employed. In particular, when the chargeable resin is an anionic polymer, it is preferable to employ a cationic surfactant with a relatively long alkyl chain having 10 or more carbon atoms. It is also preferable to use the previously mentioned fluorine-containing quaternary ammonium salts.

It is preferable that the parts-by-weight ratio of the amount of the releasing-agent-coated particles to that of the chargeable finely-divided resin be in the range of (100:1) to (100:20), more preferably in the range of (100:3) to (100:15), for obtaining a toner with satisfactory fluidity, image transfer performance and chargeability.

(4) The Method of Coating the Releasing-Agent-Coated Particles with a Solution of a Chargeable Resin and Drying the Coated Resin Particles The chargeable resins that can be employed in this method are the same as those employed in the above-mentioned method (3). More specifically, resins having an anionic group, with a glass transition temperature (Tg) in the range of 50° C. to 80° C., and a weight average molecular weight of 3,000 to 30,000.

Furthermore, resins prepared by allowing resins having anionic groups to react with the fluorine-containing quaternary ammonium salt can be employed in the same manner as in the above-mentioned method (3).

As the dispersant used in this method, lower alcohols such as methanol and ethanol are preferably employed, when necessary, with the addition of water thereto.

The releasing agent particles can be coated with a chargeable resin by dissolving the chargeable resin in a dispersion of the releasing agent particles, or by mixing the dispersion with a solution of the chargeable resin and subjecting the mixture to spray drying.

The spraying for the spray drying is carried out by use of a spraying apparatus such as a rotary disc type spraying apparatus, a pressure nozzle type spraying apparatus, or a two-fluid nozzle type spraying apparatus. Of these, the two-fluid nozzle type spraying apparatus is preferably employed since finely-divided resin particles can be effectively obtained.

In this spray drying, for instance, methanol is employed as a dispersant. Therefore, it is necessary that the spraying be conducted by use of an inert gas such as nitrogen. Further, it is preferable that the drying be conducted at a temperature in the range of 50° C. to 100° C. The concentration of the dispersion liquid employed in this method is adjusted to be in the range of 10% to 40%, so that the dispersion liquid has an appropriate viscosity. The toner prepared by the spray drying is collected, for instance, by a cyclone, and is classified by a classifier when necessary, to remove therefrom aggregated particles or transparent finely-divided particles.

It is preferable that the parts-by-weight ratio of the amount of the releasing-agent-coated particles to that of the chargeable resin be in the range of (100:1) to (100:20), more preferably in the range of (100:3) to (100:15), for obtaining a toner with satisfactory fluidity, image transfer performance and chargeability.

As mentioned above, when the spray drying method is employed, the formation of a chargeable resin layer coated with a releasing agent layer can be conducted in a single step.

(5) The Method of Coating the Releasing-Agent-Coated Particles with a Solution of an Alkoxysilane Compound, Which Contains a Charge Controlling Agent, and Subjecting the Thus Coated Particles to Condensation Polymerization An alkoxysilane compound, when heated in the presence of a small amount of water, is converted to a polysiloxane having a small surface energy. Therefore, when the surface of each of the releasing-agent-coated particles is coated with the alkoxysilane compound, and the alkoxysilane-compound-coated, releasing-agent-coated particles are subjected to a heat treatment, the fluidity and image transfer performance of the toner particles can be significantly improved. However, the toner coated with the polysiloxane does not exhibit effective chargeability to a carrier, in particular, to a silicone-coated carrier. Therefore it is necessary to add a charge controlling agent to the toner. The charge controlling agent used in this case may be such a charge controlling agent that is insoluble in the dispersant of the releasing-agent-coated particles, but a preferable charge controlling agent is such a charge controlling agent that is soluble in the above-mentioned dispersant and also in an alkoxysilane solution, and that can be dissolved uniformly in a polysiloxane film formed by the polymerization of the alkoxysilane.

As the charge controlling agents for negative charging, the fluorine-containing quaternary ammonium salts employed in the method (1) are preferable for use.

In the present invention, any alkoxysilane compound can be employed so long as a polysiloxane is produced by the hydrolysis of the alkoxysilane compound. Specific examples of such an alkoxysilane compound are tetramethoxysilane, methyltrimethoxysilane, dimethylmethoxysilane, phenyltrimethoxysilane, tetraethoxysilane, methyltriethoxysilane, dimethylethoxysilane and alkoxysilane compounds which are commercially available as silane coupling agents. These alkoxysilane compounds can be employed alone or in combination.

A polysiloxane coating layer containing a charge controlling agent can be prepared by mixing a dispersion liquid of the releasing-agent-coated particles with a solution of the alkoxysilane compound in which the charge controlling agent is dissolved or dispersed to prepare a mixture of the releasing-agent-coated particles, the siloxane compound and the charge controlling agent, and subjecting the mixture to spray drying by any of the spraying apparatuses employed in the method (4). In this method, it is necessary to add a small amount of water to any of the dispersion liquid of the releasing-agent-coated particles and the solution of the alkoxysilane compound before or after the dispersion liquid and the solution are mixed. Furthermore, when necessary, the polysiloxane coating layer may be subjected to a heat treatment after the formation of the polysiloxane coating layer by the spray drying.

The polysiloxane coating layer containing a charge controlling agent can also be formed on the releasing-agent-coated particles by spraying a solution of the alkoxysilane compound in which the charge controlling agent is dissolved or dispersed to the releasing-agent-coated particles. Alternatively, the polysiloxane coating layer containing a charge controlling agent can be formed on the releasing-agent-coated particles by immersing the releasing-agent-coated particles in the solution of the alkoxysilane compound in which the charge controlling agent is dissolved or dispersed, and then drying the releasing-agent-coated particles.

It is preferable that the parts-by-weight ratio of the amount of the releasing-agent-coated particles to that of the alkoxysilane compound be in the range of (100:0.05) to (100:2), more preferably in the range of (100:01) to (100:1), for obtaining a toner with satisfactory fluidity, image transfer performance and image fixing performance.

It is also preferable that the parts-by-weight ratio of the amount of the releasing-agent-coated particles to that of the charge controlling agent be in the range of (100:0.05) to (100:2), more preferably in the range of (100:0.1) to (100:1), for obtaining a toner with satisfactory chargeability and image fixing performance.

(6) The Method of Coating the Releasing-Agent-Coated Particles with a Solution of an Alkoxysilane Compound, Which Contains a Chargeable Resin, and Subjecting the Thus Coated Particles to Condensation Polymerization Chargeable resins employed in this method are the same as those employed in the method (3). These resins are soluble in the dispersant for the releasing-agent-coated particles and also in a solution of the alkoxysilane compound, and are required to be uniformly dissolved in a polysiloxane film formed by the polymerization of the alkoxysilane compound.

Specific examples of the chargeable resins employed in this method are copolymers of (a) a monomer such as ethyl methacrylate, isopropyl methacrylate, isobutyl methacrylate, or tert-butyl methacrylate, and (b) a chargeable monomer such as (meth)acrylamide-2-propane sulfonic acid, (meth)acrylic acid-2-sulfoethyl, or styrene sulfonic acid. It is preferable that the amount of the chargeable monomer in the copolymers being in the range of 2 to 10 wt. % of the entire weight of each copolymer. It is also preferable that the thus prepared chargeable resins for use in this method have a glass transition temperature in the range of 50° C., to 80° C., and a weight average molecular weight of 3,000 to 30,000.

The same alkoxysilane compounds as employed in the method (5) can also be employed in this method.

The external coating layer composed of the chargeable resin and the polysiloxane can be formed in the same manner as in the method (5).

When the external coating layer composed of the chargeable resin and the polysiloxane is provided on each toner particle, the releasability of the toner is improved because the chargeable resin is fused at image fixing so that the releasing agent appears on the surface of the toner particle. Furthermore, the fluidity and image transfer performance of the toner are significantly improved by the polysiloxane in the coating layer.

It is preferable that the parts-by-weight ratio of the amount of the releasing-agent-coated particles to that of the alkoxysilane compound be in the range of (100:0.05) to (100:2), more preferably in the range of (100:01) to (100:1). It is also preferable that the parts-by-weight ratio of the amount of the releasing-agent-coated particles to that of the chargeable resin be in the range of (100:0.1) to (100:3), more preferably in the range of (100:0.3) to (100:2).

(7) The Method of Coating the Releasing-Agent-Coated Particles with an Alkoxysilane Compound Having a Chargeable Group Alkoxysilane compounds employed in this method are those having a chargeable group such as amino group, quaternary ammonium salt, or perfluoroalkyl group.

Examples of an alkoxysilane compound having an amino group are $H_2N(CH_2)_3Si(OCH_3)_3$, $H_2N(CH_2)_3—NH(CH_2)_3Si(OCH_3)_3$, $C_6H_5—NH(CH_2)_3Si(OCH_3)_3$, and $(C_4H_9)NH(CH_2)_3Si(OCH_3)_3$.

Examples of an alkoxysilane compound having a perfluoroalkyl group are $CF_3(CH_2)_2Si(OCH_3)_3$, $CF_3(CF_2)_3(CH_2)_2(Si(COCH_3)_3$, $CF_3(CF_2)_7(CH_2)_2Si(OCH_3)_3$, $CF_3COO(CH_2)_2Si(OCH_3)_3$, and $CF_3COOCF_2(CH_2)_2Si(OCH_3)_3$.

In this method, the above-metnioend alkoxysilane compounds having the chargeable groups (hereinafter referred to as the chargeable alkoxysilane compounds) can be used in combination with the alkoxysilane compounds employed in the method (5). In this case, it is preferable that the parts-by-weight ratio of the amount of the alkoxysilane compound employed in the method (5) to the amount of the chargeable alkoxysilane compound be in the range of (0:100) to (10:90).

The releasing-agent-coated particles can be coated with the chargeable alkoxysilane compound in the same manner as in the method (5). When necessary, the releasing-agent-coated particles coated with the chargeable alkoxysilane compound may be subjected to a heat treatment.

It is preferable that the parts-by-weight ratio of the amount of the releasing-agent-coated particles to that of the alkoxysilane compound be in the range of (100:0.1) to (100:10), more preferably in the range of (100:0.5) to (100:5), for obtaining a toner with satisfactory fluidity, image transfer performance, and chargeability.

A fluidity promoting agent may be added to the thus prepared toner with the external layer composed of the chargeable resin, so that the fluidity and image transfer performance of the toner can be further improved.

Specific examples of such a fluidity promoting agent are finely-divided particles of hydrophobic silica, titanium oxide, or zinc oxide; and fatty acid metal salts such as potassium stearate, and zinc stearate.

Such a fluidity promoting agent and the toner can be mixed in a conventional mixing apparatus such as V blender, and Henschel Mixer (made by Mitsui Miike Eng. Corp.).

When the thus prepared toner is used as a two-component developer, the toner is mixed with a carrier. As such a carrier, conventional carriers, for example, finely-divided magnetic particles of iron, magnetite, hematite, and ferrite, and glass beads, can be employed. It is preferable that these carrier particles have a particle size in the range of 30 μm to 500 μm. In particular, carrier particles coated with a silicone resin are preferable.

Furthermore, it is preferable that the amount of the toner be in the range of 0.5 to 5 parts by weight to 100 parts by weight of the carrier. A two-component developer can be thus prepared by use of the toner of the present invention.

The features of this invention will become apparent in the course of the following description of exemplary embodiments, which are given for illustration of the invention and are not intended to be limiting thereof.

Preparation of Resin Particle Dispersion Liquid 7 parts by weight of a methylvinyl ether-maleic anhydride copolymer with a weight average molecular weight of 40,000 were added to 100 parts by weight of methanol, and the mixture was heated to dissolve the copolymer in the methanol, whereby a dispersion stabilizer solution was prepared:

The following components were placed in a four-necked flask equipped with a stirrer, a reflux condenser, a nitrogen introducing pipe, and a thermometer:

| | Parts by Weight |
|---|---|
| Dispersion stabilizer solution | 250 |
| Styrene | 60 |
| Methyl acrylate | 40 |
| Dodecyl mercaptan | 1 |

-continued

| | Parts by Weight |
|---|---|
| 1,3-butanediol dimethacrylate | 1.5 |

The flask was completely purged with nitrogen gas before initiating the polymerization reaction. The above reaction mixture was heated to 60° C. To this reaction mixture, 2.0 parts by weight of 2,2'-azobisisobutylonitrile were added to initiate the polymerization reaction. The polymerization reaction was continued with stirring at 100 rpm for 24 hours, whereby a resin particles dispersion liquid was obtained.

The particle size distribution of the resin particles in the thus obtained resin particles was measured by use of a 20 μm aperture of Coulter Multisizer II. The result was that the volume mean diameter of the resin particle was 6.73 μm, and the number mean diameter thereof was 6.600 μm, with the ratio of the volume mean diameter to the number mean diameter being 1.02, when 50,000 resin particles were counted.

The polymerization ratio in the above polymerization reaction, measured by a weight method, was 95.2%.

Preparation of Dyed Resin Particles 6 parts by weight of Oil Black 860 (made by Orient Chemical Industries, Ltd.) were added to the above prepared resin particles dispersion liquid, and the mixture was stirred at 50° C. for 2 hours.

The thus obtained dispersion liquid was cooled to room temperature, and was then subjected to centrifugation. The supernatant solution was removed from the above reaction mixture, and the remaining dispersion liquid was dispersed in a mixed solvent composed of 50 parts by weight of methanol and 50 parts by weight of water. By repeating this dispersing three times, the dispersion liquid was washed. By use of the above-mentioned mixed solvent, the concentration of the solid components contained in the dispersion liquid was adjusted so as to be 30%, whereby a dyed resin particles dispersion liquid was obtained.

Part of the above obtained dyed resin particles dispersion liquid was filtered with suction, and dried under reduced pressure, whereby dyed resin particles were obtained.

Preparation of Releasing Agent Dispersion Liquid 26 parts by weight of carnauba wax were placed in a tightly closable vessel, equipped with a stirrer, a reflux condenser, and a dropping funnel, set in an oil bath, and were gradually heated and melted at 100° C.

4 parts by weight of polyoxyethylenenolylphenol ether (average oxyethylene addition mole number=15), serving as a nonionic surfactant, were added to the melted carnauba wax with stirring, and completely dissolved therein.

70 parts by weight of water heated to 98° C. were gradually added to the above mixture with stirring, and the mixture was stirred for 1 hour. The mixture was then cooled to 25° C. with stirring, whereby a releasing agent dispersion liquid with a solid component concentration of 30 wt. % was obtained.

The volume mean diameter and the number mean diameter of the releasing agent particles in the above releasing agent dispersion liquid were measured by a commercially available dynamic light scattering spectrophotometer (Trademark "DLS-700" made by Otsuka Electronics Co., Ltd.). The result was that the volume mean diameter was 0.151 μm, and the number mean diameter was 0.110 μm.

Preparation of Releasing-Agent-Coated Particles (1)

One part by weight of the above prepared releasing agent dispersion liquid was added with stirring to 100 pats by weight of the previously prepared dyed resin particles dispersion liquid with a solid component concentration of 30%, with the temperature of the mixture maintained at 25° C.

To the above mixture, 10 parts by weight of a 0.4 wt. % methanol solution of stearylamine acetate serving as a surfactant were dropwise added with stirring until the ratio of the amount of the stearylamine acetate amounted to that of the dyed resin particles amounted to 0.13 parts by weight of the stearylamine acetate with respect to 100 parts by weight of the dyed resin particles.

The mixture was then stirred at 50° C. for 30 minutes, whereby the releasing agent particles were fixed to the surface of each of the dyed resin particles to form a releasing agent layer thereon.

Part of the thus prepared dispersion liquid was filtered with suction and dried under reduced pressure, whereby finely-divided releasing agent particles were obtained.

Part of the above prepared finely-divided releasing agent particles was dispersed again in a mixed solvent of water and methanol in such a manner as to have a solid component concentration of 30 wt. %.

Preparation of Releasing-Agent-Coated Particles (2)-(4)

The procedure for the above-mentioned preparation of the releasing-agent-coated particles was repeated except that one part by weight of the releasing agent dispersion liquid employed in the preparation of the releasing-agent-coated particles was increased to 2 parts by weight, 3 parts by weight and 4 parts by weight, whereby releasing-agent-coated particles (2), releasing-agent-coated particles (3), and releasing-agent-coated particles (4) were respectively prepared.

PREPARATION EXAMPLE 1-1

Preparation of Chargeable Finely-Divided Resin Particles for Chargeable Resin Layer—Resin Particles (1)

95 parts by weight of ion-exchange water were placed in a flask equipped with a stirrer, a dropping funnel, a nitrogen introducing pipe, a reflux condenser, and a thermometer.

The flask was completely purged with nitrogen gas and the ion-exchange water was heated to 65° C. With the temperature of the ion-exchange water maintained at 65° C., a mixture of 21 parts by weight of styrene, 9 parts by weight of n-butyl acrylate, and 3 parts by weight of methacrylic acid was added dropwise to the ion-exchange water over a period of 4 hours.

To the above reaction mixture, an aqueous solution of potassium persulfate prepared by dissolving 0.04 parts by weight of potassium persulfate in 5 parts by weight of ion-exchange water was added dropwise over a period of 6 hours, and the reaction mixture was stirred at 65° C. for 11 hours. The reaction mixture was finally heated to 80° C. for 3 hours, whereby the polymerization reaction was terminated, and a resin particles dispersion liquid was obtained.

The volume mean diameter and number mean diameter of the resin particles in the resin particles dispersion liquid were respectively measured to be 0.25 μm and 0.22 μm.

The resin particles dispersion liquid was washed two times by centrifugally replacing the dispersant of the dispersion liquid, whereby the free inorganic salt and a water-soluble oligomer were removed, so that a resin particles dispersion liquid was obtained. The thus obtained resin particles dispersion liquid was subjected to freezing drying, whereby resin particles (1) was obtained.

PREPARATION EXAMPLE 1-2

Preparation of Chargeable Finely-Divided Resin Particles for Chargeable Resin Layer—Resin Particles (2)

95 parts by weight of ion-exchange water were placed in a flask equipped with a stirrer, a dropping funnel, a nitrogen introducing pipe, a reflux condenser, and a thermometer.

The flask was completely purged with nitrogen gas and the ion-exchange water was heated to 65° C. With the temperature of the ion-exchange water maintained at 65° C., a mixture of 19 parts by weight of styrene, 9 parts by weight of n-butyl acrylate, and 2 parts by weight of sodium styrene sulfonate was added dropwise to the ion-exchange water over a period of 4 hours.

To the above reaction mixture, an aqueous solution of potassium persulfate prepared by dissolving 0.04 parts by weight of potassium persulfate in 5 parts by weight of ion-exchange water was added dropwise over a period of 6 hours, and the reaction mixture was stirred at 65° C. for 11 hours. The reaction mixture was finally heated to 80° C. for 3 hours, whereby the polymerization reaction was terminated, and a resin particles dispersion liquid was obtained.

The volume mean diameter and number mean diameter of the resin particles in the resin particles dispersion liquid were respectively measured to be 0.27 μm and 0.26 μm.

The resin particles dispersion liquid was washed two times by centrifugally replacing the dispersant of the dispersion liquid, whereby the free inorganic salt and a water-soluble oligomer were removed, so that a resin particles dispersion liquid was obtained. The thus obtained resin particles dispersion liquid was subjected to freezing drying, whereby resin particles (2) was obtained.

PREPARATION EXAMPLE 1-3

Preparation of Chargeable Finely-Divided Resin Particles for Chargeable Resin Layer—Resin Particles (3)

95 parts by weight of ion-exchange water were placed in a flask equipped with a stirrer, a dropping funnel, a nitrogen introducing pipe, a reflux condenser, and a thermometer.

The flask was completely purged with nitrogen gas and the ion-exchange water was heated to 65° C. With the temperature of the ion-exchange water maintained at 65° C., a mixture of 19 parts by weight of styrene, 9 parts by weight of n-butyl acrylate, and 2 parts by weight of 2-acrylamide-2-methylpropane sulfonic acid was added dropwise to the ion-exchange water over a period of 4 hours.

To the above reaction mixture, an aqueous solution of potassium presulfate prepared by dissolving 0.04 parts by weight of potassium persulfate in 5 parts by weight of ion-exchange water was added dropwise over a period of 6 hours, and the reaction mixture was stirred at 65° C. for 11 hours. The reaction mixture was finally heated to 80° C. for 3 hours, whereby the polymerization reaction was terminated, and a resin particles dispersion liquid was obtained.

The volume mean diameter and number mean diameter of the resin particles in the resin particles dispersion liquid were respectively measured to 0.23 μm and 0.21 μm.

The resin particles dispersion liquid was washed two times by centrifugally replacing the dispersant of the dispersion liquid, whereby the free inorganic salt and a water-soluble oligomer were removed, so that a resin particles dispersion liquid was obtained. The thus obtained resin particles dispersion liquid was subjected to freezing drying, whereby resin particles (3) was obtained.

PREPARATION EXAMPLE 1-4

Preparation of Chargeable Finely-Divided Resin Particles for Chargeable Resin Layer—Resin Particles (4)

95 parts by weight of ion-exchange water were placed in a flask equipped with a stirrer, a dropping funnel, a nitrogen introducing pipe, a reflux condenser, and a thermometer.

The flask was completely purged with nitrogen gas and the ion-exchange water was heated to 65° C. With the temperature of the ion-exchange water maintained at 65° C., a mixture of 19 parts by weight of styrene, 9 parts by weight of n-butyl acrylate, and 2 parts by weight of sodium styrene sulfonate was added dropwise to the ion-exchange water over a period of 4 hours.

To the above reaction mixture, an aqueous solution of potassium persulfate prepared by dissolving 0.04 parts by weight of potassium persulfate in 5 parts by weight of ion-exchange water was added dropwise over a period of 6 hours, and the reaction mixture was stirred at 65° C. for 11 hours. The reaction mixture was finally heated to 80° C. for 3 hours, whereby the polymerization reaction was terminated, and a resin particles dispersion liquid was obtained.

The volume mean diameter and number mean diameter of the resin particles in the resin particles dispersion liquid were respectively measured to be 0.27 μm and 0.26 μm.

The resin particles dispersion liquid was washed two times by centrifugally replacing the dispersant of the dispersion liquid, whereby the free inorganic salt and a water-soluble oligomer were removed, so that a resin particles dispersion liquid was obtained.

The thus obtained resin particles dispersion liquid was diluted with ion-exchange water in such a manner that the concentration of the solid components contained therein was 10 wt. %.

To 100 parts by weight of the thus obtained resin particles dispersion was dropwise added a methanol solution of the fluorine-containing quaternary ammonium salt (Compound 1) prepared by dissolving 0.4 parts by weight of Compound 1 in 2 parts by weight of methanol.

The mixture was stirred at 50° C. for 2 hours, so that the fluorine-containing quaternary ammonium salt was allowed to react with the resin particles, whereby a resin particles dispersion liquid was obtained.

The thus obtained resin particles dispersion liquid was washed two times by centrifugally replacing the dispersant of the dispersion liquid, whereby the free inorganic salt and a water-soluble oligomer were removed, so that a resin particles dispersion liquid was obtained.

The thus obtained resin particles dispersion was subjected to freezing drying, whereby resin particles (4) reacted with the fluorine-containing quaternary ammonium salt was obtained.

PREPARATION EXAMPLE 1-5

Preparation of Chargeable Finely-Divided Resin Particles for Chargeable Resin Layer—Resin Particles (5)

The procedure for the preparation of the resin particles (4) in Preparation Example 1-5 was repeated except that the fluorine-containing quaternary ammonium salt (Compound 1) employed in Preparation Example 1-4 was replaced by the fluorine-containing quaternary ammonium salt (Compound 2), whereby resin particles (5) reacted with the fluorine-containing quaternary ammonium salt was obtained.

PREPARATION EXAMPLE 1-6

Preparation of Chargeable Finely-Divided Resin Particles for Chargeable Resin Layer—Resin Particles (6)

The procedure for the preparation of the resin particles (1) In Preparation Example 1-1 was repeated except that the mixture of 21 parts by weight of styrene, 9 parts by weight of butyl acrylate, and 3 parts by weight of methacrylic acid employed in Preparation Example 1-1 was replaced by a mixture of 6 parts by weight of n-butyl methacrylate and 24 parts by weight of trifluoroethyl methacrylate, whereby resin particles (6) with a volume mean diameter of 0.26 μm and a number mean diameter of 0.24 μm was obtained. The glass transition point (Tg) of the resin particles was 71.9° C.

PREPARATION EXAMPLE 1-7

Preparation of Chargeable Finely-Divided Resin Particles for Chargeable Resin Layer—Resin Particles (7)

The procedure for the preparation of the resin particles (1) in Preparation Example 1-1 was repeated except that the mixture of 21 parts by weight of styrene, 9 parts by weight of butyl acrylate, and 3 parts by weight of methacrylic acid employed in Preparation Example 1-1 was replaced by a mixture of 50 parts by weight of styrene and 50 parts by weight of trifluoroethyl methacrylate, whereby resin particles (7) with a volume mean diameter of 0.27 μm and a number mean diameter of 0.24 μm was obtained. The glass transition point (Tg) of the resin particles was 61.9° C.

PREPARATION EXAMPLE 2-1

Preparation of Chargeable Resin Solution for Chargeable Resin Layer—Resin Solution (1)

A mixture of 60 parts by weight of methanol, 28.5 parts by weight of ethyl methacrylate, and 2.1 parts by weight of acrylic acid was placed in the same flask for polymerization as employed in Preparation Example 1-1. With the flask being completely purged with nitrogen gas, the above mixture was heated to 60° C., and a methanol solution of 2,2'-azobisisobutylonitrile prepared by dissolving 0.45 parts by weight of 2,2'-azobisisobutylonitrile in 10 parts by weight of methanol was dropwise added to the above mixture, with stirring at 100 rpm, and the stirring was continued in a stream of nitrogen at 60° C. for 24 hours, whereby resin solution (1) was obtained.

The glass transition point of the resin in the resin solution (1) was 63° C., and the weight average molecular weight thereof was 11,200.

PREPARATION EXAMPLE 2-2

Preparation of Chargeable Resin Solution for Chargeable Resin Layer—Resin Solution (2)

A mixture of 60 parts by weight of methanol, 18.1 parts by weight of t-butyl methacrylate, 9.8 parts by weight of methyl acrylate, and 2.1 parts by weight of sodium styrene phosphonate was placed in the same flask for polymerization as employed in Preparation Example 1-1. With the flask being completely purged with nitrogen gas, the above mixture was heated to 60° C., and a methanol solution of 2,2'-azobisisobutyronitrile prepared by dissolving 0.45 parts by weight of 2,2'-azobisisobutyronitrile in 10 parts by weight of methanol was dropwise added to the above mixture, with stirring at 100 rpm, and the stirring was continued in a stream of nitrogen at 60° C. for 24 hours, whereby resin solution (2) was obtained.

The glass transition point of the resin in the resin solution (2) was 64° C., and the weight average molecular weight thereof was 9,800.

PREPARATION EXAMPLE 2-3

Preparation of Chargeable Resin Solution for Chargeable Resin Layer—Resin Solution (3)

A mixture of 60 parts by weight of methanol, 18.1 parts by weight of t-butyl methacrylate, 9.8 parts by weight of methyl acrylate, and 2.1 parts by weight of 2-acrylamide-2-methylpropane sulfonic acid was placed in the same flask for polymerization as employed in Preparation Example 1-1. With the flask being completely purged with nitrogen gas, the above mixture was heated to 60° C., and a methanol solution of 2,2'-azobisisobutyronitrile prepared by dissolving 0.45 parts by weight of 2,2'-azobisisobutyronitrile in 10 parts by weight of methanol was dropwise added to the above mixture, with stirring at 100 rpm, and the stirring was continued in a stream of nitrogen at 60° C. for 24 hours, whereby resin solution (3) was obtained.

The glass transition point of the resin in the resin solution (3) was 65° C., and the weight average molecular weight thereof was 9,500.

PREPARATION EXAMPLE 2-4

Preparation of Chargeable Resin Solution for Chargeable Resin Layer—Resin Solution (4)

Resin solution (2) prepared in Preparation Example 2-2 was diluted with methanol in such a manner so as to obtain a resin solution with a solid component concentration of 10 wt. %.

0.3 parts by weight of the fluorine-containing quaternary ammonium salt (Compound 2) were dissolved in 2,100 parts by weight of the above prepared diluted resin solution. The mixture was then heated with stirring at 50° C. for 2 hours, whereby the fluorine-containing quaternary ammonium slat was allowed to react with the resin solution. Thus, a resin solution (4) was obtained.

EXAMPLE 1

Preparation of Toner No. 1

104 parts by weight of releasing-agent-coated particles (4) and 9 parts by weight of resin particles (1) prepared in Preparation Example 2-1 were mixed in a commercially available blender (Trademark "Osterizer" made by Oster Co., Ltd.) and the mixture was then stirred in a hybridizer (Trademark "Hybridizer NHS-1" made by Nara Machinery Co., Ltd.) at 7500 rpm for 2 minutes, thereby fixing the chargeable resin particles to the surface of each of the releasing-agent-coated particles (4). Thus, toner No. 1 of the present invention was prepared.

EXAMPLES 2 TO 5

Preparation of Toners Nos. 2 to 5

The procedure for the preparation of toner No. 1 of the present invention was repeated except that the resin particles (1) employed in Example 1 was replaced by resin particles (2), (3), (4) and (5), respectively as listed in Table 1, which were respectively prepared in Preparation Examples 2-2, 2-3, 2-4 and 2-5, whereby toners Nos. 2 to 5 of the present invention were prepared.

EXAMPLE 6

Preparation of Toner No. 6

104 parts by weight of releasing-agent-coated particles (4) and 9 parts by weight of resin particles (2) prepared in Preparation Example 2-2 were mixed in the same commercially available blender (Trademark "Osterizer" made by Oster Co., Ltd.) as employed in Example 1, whereby composite particles were prepared.

113 parts by weight of the above composite particles, 140 parts by weight of methanol, and 60 parts by weight of ion-exchange water were placed in a flask equipped with a stirrer, a reflux condenser, and a thermometer. The flask was then placed in a thermostated water bath. The mixture was slowly, but sufficiently stirred and was then gradually heated. With the temperature of the mixture maintained at 45° C., the mixture was stirred at 200 rpm for 20 minutes.

900 parts by weight of glass beads, each with a diameter of 2 mm, were then placed in the flask, and the mixture was stirred for 1 hour, with the temperature thereof maintained at 45° C.

The mixture was then continuously stirred, without heating the mixture any further, and was allowed to cool. When the temperature of the mixture was decreased to 25° C., a methanol solution of the fluorine-containing quaternary ammonium salt (Compound 2) prepared by dissolving 1 part by weight of Compound 2 in 10 parts by weight of methanol was added to the mixture. The mixture was stirred for 30 minutes.

The glass beads were removed from the mixture by a 200 μm mesh screen to obtain a dispersion liquid. The thus obtained dispersion liquid was filtered to obtain a cake. The cake was dispersed in 100 parts by weight of ion-exchange water two times to wash, and a cake was then obtained. The thus obtained cake was dried under reduced pressure overnight and was loosened and crushed, whereby toner No. 6 of the present invention was prepared.

TABLE 1

| Examples | Releasing-Agent-Coated Particles (4) (Parts) | Chargeable finely-divided Resin Particles: Resin Particles | (Parts) |
|---|---|---|---|
| 1 | 104 | Resin Particles (1) | 9 |
| 2 | 104 | Resin Particles (2) | 9 |
| 3 | 104 | Resin Particles (3) | 9 |
| 4 | 104 | Resin Particles (4) | 9 |
| 5 | 104 | Resin Particles (5) | 9 |
| 6 | 104 | Resin Particles 2 + Fluorine-containing Quaternary Ammonium salt (Compound 2) | 9 |

EXAMPLE 7

Preparation of Toner No. 7

103 parts by weight of releasing-agent-coated particles (3), 0.5 parts by weight of a charge controlling agent (zinc salicylate: commercially available under the trademark "Bontron E84" from Orient Chemical Industries, Ltd.), and 6 parts by weight of resin particles (3) were mixed in the commercially available blender (Trademark "Osterizer" made by Oster Co., Ltd.), and the mixture was then stirred in the hybridizer (Trademark "Hybridizer NHS-1" made by Nara Machinery Co., Ltd.) at 12,000 rpm for 5 minutes, thereby fixing the chargeable resin particles to the surface of each of the releasing-agent-coated particles (3). Thus, toner No. 7 of the present invention was prepared.

The toner particles of the thus prepared toner No.; 7 were inspected by a scanning type electron microscope. The result was that the surface of each toner particle was smooth. A cross section of each of the toner particles was dyed with $RuO_4$ and the dyed cross section was inspected by a transmission type electron microscope. The result was that 95% of the releasing agent layer was coated with a resin layer of the chargeable resin, and the charge controlling agent was uniformly dispersed in the resin layer.

EXAMPLES 8 TO 10

Preparation of Toners Nos. 8 to 10

The procedure for the preparation of toner No. 7 of the present invention was repeated except that the resin particles (1) and the charge controlling agent employed in Example 7 were respectively replaced by the charge controlling agent and the particles as listed in Table 2, whereby toners Nos. 8 to 10 of the present invention were prepared.

TABLE 2

| Examples | Releasing-Agent-Coated Particles (3) (Parts) | Charge Controlling Agent: Type | (Parts) | Chargeable finely-divided Resin Particles: Resin Particles | (Parts) |
|---|---|---|---|---|---|
| 7 | 103 | A | 0.5 | Resin Particles (3) | 6 |
| 8 | 103 | B | 0.5 | Resin Particles (6) | 6 |
| 9 | 103 | A | 0.5 | Resin Particles (7) | 6 |
| 10 | 103 | B | 0.5 | Resin | 6 |

TABLE 2-continued

| Examples | Releasing-Agent-Coated Particles (3) (Parts) | Charge Controlling Agent Type | Charge Controlling Agent (Parts) | Chargeable finely-divided Resin Particles Resin Particles | Chargeable finely-divided Resin Particles (Parts) |
|---|---|---|---|---|---|
| | | | | particles (7) | |

Charge Controlling Agents:
A: Zinc Salicylate (Trademark "Bontron E84" made by Orient Chemical Industries, Ltd.)
B: Chromium-containing Azo Dye (Trademark "Aizen Spilon Black TRH" made by Hodogaya Chemical Co., Ltd.)

EXAMPLE 11

Preparation of Toner No. 11

15 parts by weight of releasing-agent-coated particles (4), 65 parts by weight of methanol, and 20 parts by weight of ion-exchange water were mixed to prepare a dispersion liquid.

10 parts of resin solution (1) with the resin concentration thereof adjusted to 50 wt. % were added to the above dispersion liquid with stirring.

80 parts by weight of ion-exchange water were dropwise added to the above mixture with stirring over a period of 3 hours.

0.2 parts by weight of potassium sulfate serving as an auxiliary agent for deposition were added to the above mixture, and the mixture was stirred for 30 minutes. The mixture was then ice-cooled, whereby a dispersion liquid of composite particles composed of the releasing-agent-coated particles which were coated with the chargeable resin was obtained. The thus obtained dispersion liquid was washed two times by centrifugally replacing the dispersant of the dispersion liquid, filtered and dried under reduced pressure to obtain a lump of toner. The thus obtained lump of toner was crushed to prepare toner No. 11 of the present invention.

Toner particles of the thus prepared toner No. 11 were inspected by a scanning type electron microscope. The result was that resin particles were deposited in the shape of a network on the surface of each dyed resin particle having a releasing agent layer.

EXAMPLES 12 TO 14

Preparation of Toners Nos. 12 to 14

The procedure for the preparation of toner No. 11 of the present invention was repeated except that the resin solution (1) and the auxiliary agent for deposition employed in Example 11 were respectively replaced by the resin solution and the auxiliary agent for deposition as listed in Table 3, whereby toners Nos. 1 to 18 of the present invention were prepared.

TABLE 3

| Examples | Releasing-Agent-Coated Particles (4) (Parts) | 50% Resin Solution Resin Solution | 50% Resin Solution (Parts) | Auxiliary Agent for Deposition Type | Auxiliary Agent for Deposition (Parts) |
|---|---|---|---|---|---|
| 11 | 15 | Resin Solution (1) | 10 | A | 0.2 |
| 12 | 15 | Resin Solution (2) | 10 | A | 0.2 |
| 13 | 15 | Resin Solution (3) | 10 | A | 0.2 |
| 14 | 15 | Resin | 10 | B | 0.2 |

TABLE 3-continued

| Examples | Releasing-Agent-Coated Particles (4) (Parts) | 50% Resin Solution Resin Solution | 50% Resin Solution (Parts) | Auxiliary Agent for Deposition Type | Auxiliary Agent for Deposition (Parts) |
|---|---|---|---|---|---|
| | | Solution (2) | | | |

Auxiliary Agents:
A: Potassium sulfate
B: Fluorine-containing Quaternary Ammonium salt (Compound 2)

EXAMPLE 15

Preparation of Toner No. 15

20 parts by weight of releasing-agent-coated particles (2) were dispersed in 80 parts by weight of methanol to prepare a dispersion. To this dispersion, one part by weight of resin solution (1) with the resin concentration thereof adjusted to 10 wt. % was added. The mixture was stirred, and then dried in a commercially available spray dryer (Trademark "Pulvis Mini-Spray Model GS-31" made by Yamato Scientific Co., Ltd.), with the temperature at the inlet set at 80° C. and that at the outlet set at 50° C. by spraying nitrogen gas to the mixture, whereby toner was obtained in the form of a dried powder.

The thus obtained toner was inspected by an optical microscope. The result was that finely-divided transparent particles were contained in the toner. Therefore, those transparent particles were removed from the toner by classification, whereby toner No. 15 of the present invention was obtained.

Toner particles of the thus prepared toner No. 15 were inspected by a scanning type electron microscope. The result was that the surface of each of the releasing-agent-coated particles was uniformly coated with the resin.

EXAMPLES 16 TO 18

Preparation of Toners Nos. 12 to 18

The procedure for the preparation of toner No. 15 of the present invention was repeated except that the resin solution (1) with the adjusted resin concentration employed in Example 15 was replaced with the respective resin solutions as listed in Table 4, whereby toners Nos. 16 to 18 of the present invention were prepared.

Toner particles of each of the thus prepared toners No. 16 to No. 18 were inspected by a scanning type electron microscope. The result was that the surface of the releasing-agent-coated particles in each of toners No. 16 to No. 18 was uniformly coated with the resin.

TABLE 4

| Examples | Releasing-Agent-Coated Particles (3) (Parts) | 10% Resin Solution Resin Solution | 10% Resin Solution (Parts) |
|---|---|---|---|
| 15 | 20 | Resin Solution (1) | 1 |
| 16 | 20 | Resin Solution (2) | 1 |
| 17 | 20 | Resin Solution (3) | 1 |
| 18 | 20 | Resin Solution (4) | 1 |

EXAMPLE 19

Preparation of Toner No. 19

30 parts by weight of releasing-agent-coated particles (2), 53 parts by weight of methanol, and 22 parts by weight of ion-exchange water were mixed to prepare a dispersion. To this dispersion, 0.15 parts by weight of phenyltriethoxysilane dissolved in 10 parts by weight of methanol were added.

To this dispersion, 2 parts by weight of resin solution (1) with the resin concentration thereof adjusted to 10 wt. % was added. The mixture was stirred, and then dried in a commercially available spray dryer (Trademark "Pulvis Mini-Spray Model GS-31" made by Yamato Scientific Co., Ltd.), with the temperature at the inlet set at 80° C. and that at the outlet set at 50° C. by spraying nitrogen gas to the mixture, whereby toner No. 19 of the present invention was obtained in the form of a dried powder.

The thus obtained toner No. 19 was inspected by an optical microscope. The result was that no finely-divided transparent particles were found in the toner. The toner particles of the thus prepared toner No. 19 were inspected by a scanning type electron microscope. The result was that the surface of each of the releasing-agent-coated particles was uniformly coated with the resin.

EXAMPLES 20 TO 22

Preparation of Toners Nos. 20 to 22

The procedure for the preparation of toner No. 19 of the present invention was repeated except that the alkoxysilane compound, specifically phenyltriethoxysilane, and the resin solution (1) with the adjusted resin concentration employed in Example 19 was replaced with the respective alkoxysilane compounds and resin solution as listed in Table 5, whereby toners Nos. 20 to 22 of the present invention were prepared.

Each of the thus obtained toners No. 20 to No. 22 was inspected by an optical microscope. The result was that no finely-divided transparent particles were found in any of the toners.

The toner particles of each of the thus prepared toners No. 20 to No. 22 were inspected by a scanning type electron microscope. The result was that the surface of the releasing-agent-coated particles was uniformly coated with the resin in each of the toners.

TABLE 5

| Examples | Releasing-Agent-Coated Particles (2) (Parts) | Alkoxysilane Compound (Parts) | 10% Resin Solution Resin Solution | (Parts) |
|---|---|---|---|---|
| 19 | 30 | Phenyltriethoxysilane (0.15) | Resin Solution (1) | 2 |
| 20 | 30 | Phenyltriethoxysilane (0.15) | Resin Solution (2) | 2 |
| 21 | 30 | Methyltrimethoxysilane (0.15) | Resin Solution (3) | 2 |
| 22 | 30 | Methyltrimethoxysilane (0.15) | Resin Solution (3) | 1.4 |

When the mixture of the alkoxysilane compound and the resin solution in each of the examples in Table 5 was heated and dried, a transparent film was formed.

EXAMPLE 23

Preparation of Toner No. 23

30 parts by weight of releasing-agent-coated particles (2), 53 parts by weight of methanol, and 22 parts by weight of ion-exchange water were mixed to prepare a dispersion. To this dispersion, 0.045 parts by weight of phenyltriethoxysilane serving as alkoxysilane compound (1) and 0.045 parts by weight of dimethoxysilane compound serving as alkoxysilane compound (2) dissolved in 10 parts by weight of methanol, and the fluorine-containing quaternary ammonium salt (Compound 2) were added.

To this dispersion, 1 parts by weight of resin solution (1) with the resin concentration thereof adjusted to 10 wt. % was added. The mixture was stirred, and then dried in a commercially available spray dryer (Trademark "Pulvis Mini-Spray Model GS-31" made by Yamato Scientific Co., Ltd.), with the temperature at the inlet set at 80° C. and that at the outlet set at 50° C. by spraying nitrogen gas to the mixture, whereby toner No. 23 of the present invention was obtained in the form of a dried powder.

The thus obtained toner No. 23 was inspected by an optical microscope. The result was that no finely-divided transparent particles were found in the toner. The toner particles of the thus prepared toner No. 23 were inspected by a scanning type electron microscope. The result was that the surface of each of the releasing-agent-coated particles was uniformly coated with the resin.

EXAMPLES 24 TO 26

Preparation of Toners Nos. 24 to 26

The procedure for the preparation of toner No. 23 of the present invention was repeated except that the alkoxysilane compounds (1) and (2), and the resin solution (1) with the adjusted resin concentration employed in Example 23 was replaced with the respective alkoxysilane compounds (1) and (2) and resin solutions as listed in Table 4, whereby toners Nos. 24 to 26 of the present invention were prepared.

Each of the thus obtained toners No. 24 to No. 26 was inspected by an optical microscope. The result was that no finely-divided transparent particles were found in any of the toners.

The toner particles of each of the thus prepared toners No. 24 to No. 26 were inspected by a scanning type electron microscope. The result was that the surface of the releasing-agent-coated particles was uniformly coated with the resin in each of the toners.

TABLE 6

| Examples | Releasing-Agent-Coated Particles (2) (Parts) | Alkoxysilane Compound (1) (Parts) | Alkoxysilane Compound (2) (Parts) | Charge Controlling Agent (Parts) | |
|---|---|---|---|---|---|
| 23 | 30 | Phenyltrimethoxysilane (0.045) | dimethyldimethoxysilane (0.045) | Compound 2 | 0.09 |
| 24 | 30 | Phenyltrimethoxysilane (0.063) | dimethyldimethoxysilane (0.027) | Compound 2 | 0.09 |
| 25 | 30 | Methyltrimethoxysilane (0.038) | phenylmethyldimethoxysilane (0.038) | Compound 2 | 0.09 |

TABLE 6-continued

| Examples | Releasing-Agent-Coated Particles (2) (Parts) | Alkoxysilane Compound (1) (Parts) | Alkoxysilane Compound (2) (Parts) | Charge Controlling Agent (Parts) | |
|---|---|---|---|---|---|
| 26 | 30 | Methyltrimethoxy-silane (0.053) | phenylmethyl-dimethoxysilane (0.025) | Compound 2 | 0.09 |

When the mixture of the alkoxysilane compounds (1) and (2) and the resin solution in each of the examples in Table 6 was heated and dried, a transparent film was formed.

EXAMPLE 27

Preparation of Toner No. 27

30 parts by weight of releasing-agent-coated particles (2), 53 parts by weight of methanol, and 22 parts by weight of ion-exchange water were mixed to prepare a dispersion.

To this dispersion was added an alkoxysilane compound methanol solution which was prepared by dissolving 0.072 parts by weight of $CF_3(CH_2)_2Si(OCH_3)_3$ serving as a chargeable alkoxysilane compound (1) and 0.18 parts by weight of diphenylmethoxysilane serving as a non-chargeable alkoxysilane compound (2) in 10 parts by weight of methanol.

To this dispersion, 1 part by weight of resin solution (1) with the resin concentration thereof adjusted to 10 wt. % was added. The mixture was stirred, and then dried in a commercially available spray dryer (Trademark "Pulvis Mini-Spray Model GS-31" made by Yamato Scientific Co., Ltd.), with the temperature at the inlet set at 80° C. and that at the outlet set at 50° C. by spraying nitrogen gas to the mixture, whereby toner No. 27 of the present invention was obtained in the form of a dried powder.

The thus obtained toner No. 27 was inspected by an optical microscope. The result was that no finely-divided transparent particles were found in the toner. The toner particles of the thus prepared toner No. 27 were inspected by a scanning type electron microscope. The result was that the surface of the releasing-agent-coated particles was uniformly coated with the resin.

EXAMPLES 28 TO 30

Preparation of Toners Nos. 28 to 30

The procedure for the preparation of toner No. 27 of the present invention was repeated except that the chargeable alkoxysilane compound (1) and the non-chargeable alkoxysilane compound (2) employed in Example 27 were respectively replaced by the respective chargeable alkoxysilane compound (1) and non-chargeable alkoxysilane compound (2) listed in Table 7, whereby toners Nos. 28 to 30 of the present invention were prepared.

Each of the thus obtained toners No. 28 to No. 30 was inspected by an optical microscope. The result was that no finely-divided transparent particles were found in any of the toners.

The toner particles of each of the thus prepared toners No. 28 to No. 30 were inspected by a scanning type electron microscope. The result was that the surface of the releasing-agent-coated particles was uniformly coated with the resin in each of the toners.

TABLE 7

| Examples | Releasing-Agent-Coated Particles (2) (Parts) | Alkoxysilane Compound (1) Type | Alkoxysilane Compound (1) (Parts) | Alkoxysilane Compound (2) (Parts) |
|---|---|---|---|---|
| 27 | 30 | A | 0.072 | diphenyldimethoxy-silane (0.18) |
| 28 | 30 | B | 0.045 | diphenyldimethoxy-silane (0.045) |
| 29 | 30 | B | 0.072 | diphenyldimethoxy-silane (0.18) |
| 30 | 30 | C | 0.072 | diphenyldimethoxy-silane (0.18) |

Alkoxysilane Compound (1)
A = $CF_3CH_2CH_2Si(OCH_3)_3$
B = $CH_3CF_2)_3CH_2CH_2Si(OCH_3)_3$
C = $CH_3(CF_2)CH_2CH_2Si(OCH_3)_3$

COMPARATIVE EXAMPLE 1

100 parts by weight of releasing-agent-coated particles (3) and 1.0 parts by weight of a charge controlling agent powder (commercially available under the trademark "Bontron E84" from Orient Chemical Industries, Ltd.) were mixed in the commercially available blender (Trademark "Osterizer" made by Oster Co., Ltd.), and the mixture was then stirred in the hybridizer (Trademark "Hybridizer NHS-1" made by Nara Machinery Co., Ltd.) at 10,000 rpm for 2 minutes, thereby fixing the charge controlling agent to the surface of each of the releasing-agent-coated particles (3). Thus, comparative toner No. 1 was prepared.

The toner particles of the thus prepared comparative toner No. 1 were inspected by a scanning type electron microscope. The result was that the surface of each toner particle was smooth. A cross section of each of the toner particles was dyed with $RuO_4$ and the dyed cross section was inspected by a transmission type electron microscope. The result was that the surface of the toner particles was covered with the releasing agent, and the charge controlling agent particles were found embedded from place to place in the surface portions of the toner particles.

COMPARATIVE EXAMPLE 2

100 parts by weight of styrene-acryl copolymer resin, 50 parts by weight of a low-molecular weight polypropylene (Trademark "Himer 550p" made by Sanyo Chemical Industries, Ltd.) serving as a releasing agent, 6 parts by weight of carbon black (Trademark "#44" made by Mitsubishi Chemical Industries, Ltd.) and 2 parts by weight of a commercially available negative charge controlling agent (Trademark "Bontron E84" made by Orient Chemical Industries, Ltd.) were kneaded in a three-roll mill at 120° C. for 30 minutes.

The mixture was then pulverized in a jet mill to prepare finely-divided resin particles with an average particle size of 1.9 $\mu$m.

100 parts by weight of the dyed resin particles and 10 parts by weight of the above prepared finely-divided resin particles were mixed in a commercially available blender (Trademark "Osterizer" made by Oster Co., Ltd.).

The above mixture was inpsected by an optical microscope. The result was that the finely-divided resin particles were not uniformly deposited on the dyed resin particles.

The mixture was then stirred in a hybridizer (Trademark "Hybridizer NHS-1" made by Nara Machinery Co., Ltd.) at 7500 rpm for 3 minutes, thereby fixing the finely-divided resin particles to the surface of the dyed resin particles, whereby comparative toner No. 2 was prepared.

A cross section of each of the toner particles of the comparative toner was dyed with $RuO_4$ and the dyed cross section was inspected by a transmission type electron microscope. The result was that the low-molecular weight polypropylene used as the releasing agent was present in the form of particles on the surface of the toner particles.

COMPARATIVE EXAMPLE 3

100 parts by weight of styrene-acryl copolymer resin, 6 parts by weight of carbon black (Trademark "#44" made by Mitsubishi Chemical Industries, Ltd.) and 2 parts by weight of a commercially available negative charge controlling agent (Trademark "Bontron E84" made by Orient Chemical Industries, Ltd.) were kneaded in a three-roll mill at 120° C. for 30 minutes.

The mixture was then pulverized in a jet mill to prepare finely-divided resin particles with an average particle size of 1.2 [2m.

100 parts by weight of the dyed resin particles and 10 parts by weight of the above prepared finely-divided resin particles were mixed in a commercially available blender (Trademark "Osterizer" made by Oster Co., Ltd.).

The above mixture was inpsected by an optical microscope. The result was that the finely-divided resin particles were not uniformly deposited on the dyed resin particles.

The mixture was then stirred in a hybridizer (Trademark "Hybridizer NHS-1" made by Nara Machinery Co., Ltd.) at 7500 rpm for 3 minutes, thereby fixing the finely-divided resin particles to the surface of the dyed resin particles, whereby comparative toner No. 3 was prepared.

A cross section of each of the toner particles of the comparative toner was inspected by a transmission type electron microscope. The result was that only a resin layer was present on the surface portions of the toner particles.

Evaluation of Toners Nos. 1 to 30 of the Present Invention and Comparative Toners Nos. 1 to 3

100 parts by weight of each of Toners Nos. 1 to 30 of the present invention and Comparative Toners Nos. 1 to 3 were mixed with 1 part by weight of hydrophobic silica to prepare 33 toner mixtures.

5 parts by weight of each of the above toner mixtures were mixed with 100 parts by weight of silicone-resin coated ferrite carrier particles with a particle size of 100 μm. The mixture was stirred in a ball mill for 10 minutes, whereby each developer was prepared.

By use of each developer in a commercially available plaint paper copying machine (Trademark "Imagio 420" made by Ricoh Co., Ltd.), without the application of a silicone oil to image fixing rollers thereof, copies were made and each developer was evaluated with respect to the image quality obtained by the developer as follows:

(1) Releasability

By use of an original with all black solid images, copies were made, and the formation of marks of sheet pick-off pawls in the leading edge portion of each copy was inspected, whereby each developer was evaluated with respect to the releasability with the following 5 grades:

Grade 5: No marks were formed.

Grade 1: The marks were considerably formed.

Grades 2, 3, and 4 are the grades between Grade 1 and Grade 5, and as the number of the grade increases, the quality of the releasability increases.

(2) Offset Phenomenon

By use of an original with solid black stripe images with a width of 50 mm, copies were made, and the smearing of the non-image areas by the occurrence of the offset phenomenon was inspected, whereby each developer was evaluated with respect to the occurrence of the offset phenomenon with the following 5 grades:

Grade 5: No offset phenomenon took place.

Grade 1: The offset phenomenon took place, so that the non-image areas were considerably smeared.

Grades 2, 3, and 4 are the grades between Grade 1 and Grade 5, and as the number of the grade increases, the offset phenomenon occurred less.

(3) Image Fixing Performance

By use of an original with solid black stripe images with a width of 50 mm, copies were made, and the images formed were rubbed by use of a drawing testing machine, whereby the rubbed marks were inspected, so that each developer was evaluated with respect to the image fixing performance thereof with the following 5 grades:

Grade 5: No rubbed marks were observed.

Grade 1: Rubbed marks were clearly observed.

Grades 2, 3, and 4 are the grades between Grade 1 and Grade 5, and as the number of the grade increases, rubbed marks were less formed.

(4) Resolution

Dot images developed by each developer were inspected by an optical microscope and the reproduction quality of the dot images was inspected, whereby each developer was evaluated with respect to the resolution with the following 5 grades:

Grade 5: Dot images were clearly reproduced.

Grade 1: Developed dot images were extremely unclear, with the toner particles being scattered in the developed dot images.

Grades 2, 3, and 4 are the grades between Grade 1 and Grade 5, and as the number of the grade increases, the developed dot images were clearer.

(5) Image Transfer

By use of an original with all black solid images, latent electrostatic images formed on the photoconductor of the copying machine were developed to toner images with each developer, and the copying machine was stopped in the course of the image transfer of the developed toner images to an image receiving medium. An adhesive sheet with a known weight and a known area was applied to the surface of the photoconductor so that the toner remaining on the surface of the photoconductor was collected, and the amount of the toner in the area of the photoconductor in which the image transfer has been completed, and the amount of the toner in the area of the photoconductor in which the image transfer has not yet been completed were respectively measured. From this measurement, the ratio of the transfer of the toner was calculated in terms of percentage, whereby each developer was evaluated with respect to the image transfer with the following 5 grades:

Grade 5: 90% or more of the toner has been transferred.

Grade 1: 10% or less of the toner has been transferred.

Grades 2, 3, and 4 are the grades between Grade 1 and Grade 5, and as the number of the grade increases, the ratio of the transfer of the toner increases, and image transfer is improved.

The results of the evaluations (1) to (5) are shown in Tables 8-(1) and 8-(2), in which Grade 4.5 means a grade between Grade 4 and Grade 5.

(6) Image Density

By use of an original with 5 circular solid black images with a diameter of 10 mm, copies were made at room temperature and humidity, and the image densities of the five images were measured by a Mcbeth densitometer and an average image density thereof was calculated.

The results are shown in Tables 8-(1) and 8-(2).

(7) Charge Quantity of Toner 5 parts by weight of each toner mixture were mixed with 100 parts by weight of silicone-resin coated ferrite carrier particles with a particle size of 100 μm. The mixture was stirred in a ball mill for 10 minutes, so that each developer was prepared and the charge quantity (μC/g) of the toner of each developer was measured by a blow-off measurement apparatus under the following different conditions:

(a) Low Temperature and Low Humidity

After each developer was allowed to stand at 15° C. and 10% RH for 2 hours, the charge quantity of the toner was measured.

(b) Room Temperature and Room Humidity

After each developer was allowed to stand at 25° C. and 30% RH for 2 hours, the charge quantity of the toner was measured.

(c) High Temperature and High Humidity

After each developer was allowed to stand at 30° C. and 90% RH for 2 hours, the charge quantity of the toner was measured.

(d) After Making 100,000 Copies

The charge Quantity of the toner of each developer was measured after making 100,000 copies by a commercially available copying machine (Trademark "Imagio 420" made by Ricoh Co., Ltd.).

The results are shown in Tables 8-(1) and 8-(2).

The developers which have Grade 3 or less with respect to at least one of the performances (1) to (5) cannot be used in practice.

TABLE 8-(1)

| Examples | Releas-ability | Off-Set Phenomenon | Image Fixing Performance | Image Resolu-tion | Image Transfer | Image Density | Charge Quantity of Toner (μc/g) Low Temp. & Humid. | Room Temp. & Humid. | High Temp. & Humid. | After making 100,000 copies |
|---|---|---|---|---|---|---|---|---|---|---|
| 1 | 4 | 5 | 5 | 4 | 5 | 1.45 | −20.3 | −16.3 | −10.1 | −13.2 |
| 2 | 5 | 5 | 5 | 5 | 5 | 1.40 | −28.2 | −24.0 | −19.4 | −20.8 |
| 3 | 5 | 5 | 5 | 5 | 5 | 1.38 | −32.0 | −27.1 | −20.8 | −22.6 |
| 4 | 5 | 5 | 5 | 5 | 5 | 1.35 | −33.8 | −32.7 | −34.9 | −30.1 |
| 5 | 5 | 5 | 5 | 5 | 5 | 1.36 | −33.7 | −32.2 | −34.0 | −29.5 |
| 6 | 5 | 5 | 5 | 5 | 4.5 | 1.38 | −31.0 | −31.4 | −32.8 | −28.1 |
| 7 | 5 | 5 | 4.5 | 5 | 5 | 1.34 | −33.1 | −31.1 | −15.7 | −27.2 |
| 8 | 5 | 5 | 4.5 | 5 | 5 | 1.35 | −33.4 | −32.2 | −28.2 | −29.2 |
| 9 | 5 | 5 | 5 | 5 | 5 | 1.37 | −32.1 | −30.5 | −25.6 | −28.4 |
| 10 | 5 | 5 | 5 | 5 | 5 | 1.32 | −32.1 | −31.6 | −28.0 | −30.0 |
| 11 | 4 | 5 | 5 | 4 | 5 | 1.44 | −22.1 | −17.2 | −11.8 | −13.8 |
| 12 | 5 | 5 | 5 | 5 | 5 | 1.41 | −29.6 | −25.4 | −20.2 | −22.1 |
| 13 | 5 | 5 | 5 | 5 | 5 | 1.37 | −30.1 | −28.3 | −22.7 | −25.0 |
| 14 | 5 | 5 | 5 | 5 | 5 | 1.36 | −31.3 | −30.3 | −32.8 | −27.6 |
| 15 | 4 | 5 | 5 | 4 | 4 | 1.38 | −19.7 | −18.3 | −8.6 | −15.0 |
| 16 | 4.5 | 5 | 5 | 5 | 4.5 | 1.37 | −28.7 | −24.2 | −18.1 | −20.0 |
| 17 | 4.5 | 5 | 5 | 5 | 4.5 | 1.37 | −31.2 | −28.4 | −20.8 | −26.2 |

TABLE 8-(2)

| Examples | Releas-ability | Off-Set Phenomenon | Image Fixing Performance | Image Resolu-tion | Image Transfer | Image Density | Charge Quantity of Toner (μc/g) Low Temp. & Humid. | Room Temp. & Humid. | High Temp. & Humid. | After making 100,000 copies |
|---|---|---|---|---|---|---|---|---|---|---|
| 18 | 4.5 | 5 | 5 | 5 | 4.5 | 1.35 | −31.0 | −31.4 | −32.5 | −30.1 |
| 19 | 4 | 5 | 5 | 4 | 4.5 | 1.45 | −18.1 | −15.2 | −11.6 | −13.0 |
| 20 | 5 | 5 | 5 | 5 | 4.5 | 1.38 | −26.3 | −24.1 | −21.1 | −21.7 |
| 21 | 5 | 5 | 5 | 5 | 4.5 | 1.39 | −29.6 | −27.1 | −23.6 | −24.6 |
| 22 | 5 | 5 | 5 | 5 | 4.5 | 1.40 | −28.0 | −25.8 | −23.1 | −22.5 |
| 23 | 4.5 | 5 | 4.5 | 5 | 5 | 1.37 | −28.9 | −28.6 | −29.9 | −27.0 |
| 24 | 4.5 | 5 | 4 | 5 | 5 | 1.36 | −29.9 | −29.0 | −30.5 | −27.3 |
| 25 | 4.5 | 5 | 4.5 | 5 | 5 | 1.37 | −27.9 | −27.7 | −29.1 | −25.9 |
| 26 | 4.5 | 5 | 4 | 5 | 5 | 1.38 | −26.9 | −26.5 | −28.0 | −24.8 |
| 27 | 4 | 5 | 4.5 | 4.5 | 5 | 1.40 | −22.0 | −20.5 | −19.0 | −18.0 |
| 28 | 4.5 | 5 | 4.5 | 4.5 | 5 | 1.42 | −20.5 | −18.9 | −17.9 | −17.0 |
| 29 | 4 | 5 | 4.5 | 4.5 | 5 | 1.39 | −25.6 | −23.7 | −22.2 | −22.0 |
| 30 | 4.5 | 5 | 4.5 | 4.5 | 5 | 1.39 | −27.0 | −25.0 | −23.3 | −23.2 |
| Comp. Ex. 1 | 2 | 5 | 2 | 3 | 1 | 0.42 | −28.2 | −25.6 | −20.2 | −17.2 |

TABLE 8-(2)-continued

| Examples | Releas-ability | Off-Set Phenomenon | Image Fixing Performance | Image Resolu-tion | Image Transfer | Image Density | Charge Quantity of Toner (μc/g) Low Temp. & Humid. | Room Temp. & Humid. | High Temp. & Humid. | After making 100,000 copies |
|---|---|---|---|---|---|---|---|---|---|---|
| Comp. Ex. 2 | 3 | 5 | 3 | 2 | 2 | 1.01 | −29.9 | −26.4 | −12.9 | −7.1 |
| Comp. Ex. 3 | 1 | 1 | 5 | 3 | 2 | 1.05 | −30.0 | −26.7 | −24.1 | −21.8 |

What is claimed is:

1. A toner for use in electrostatic development comprising toner particles, each toner particle comprising:

a core particle comprising a thermoplastic resin and a coloring agent;

a releasing agent in the form of particles, which substantially cover the surface of said core particle; and a chargeable resin which covers at least part of the surface of said releasing agent particles.

2. The toner as claimed in claim 1, wherein said chargeable resin further comprises a charge controlling agent.

3. The toner as claimed in claim 1, wherein said chargeable resin has an anionic group, and a charge controlling function is imparted thereto by the reaction of said chargeable resin with a charge controlling compound selected from the group consisting of:

$RfN^+(R_1)_3X^-$, Compound 1

-continued

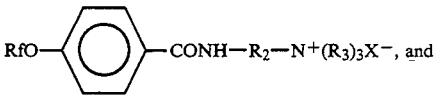

Compound 2

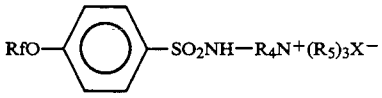

Compound 3 wherein Rf is a fluorine-containing group, preferably a straight or branched perfluoroalkyl group or perfluoroalkenyl group; $R_1$, $R_2$, $R_3$, $R_4$ and $R_5$ each represents a lower alkyl group, and $X^-$ is an organic or inorganic anion.

4. The toner as claimed in claim 3, wherein said chargeable resin comprises an acrylic resin having a sulfonic group, with which Compound 2 is caused to be reacted.

5. The toner as claimed in claim 1, wherein said chargeable resin is in the form of a layer with a thickness of 0.5 μm or less.

* * * * *